US012326260B1

(12) United States Patent
Crawley et al.

(10) Patent No.: US 12,326,260 B1
(45) Date of Patent: Jun. 10, 2025

(54) AXIAL FUEL STAGE INJECTOR CREATING AIR CURTAIN

(71) Applicant: GE Infrastructure Technology LLC, Greenville, SC (US)

(72) Inventors: Bradley D. Crawley, Greenville, SC (US); Michael John Hughes, State College, PA (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/659,371

(22) Filed: May 9, 2024

(51) Int. Cl.
*F23R 3/34* (2006.01)
*F23R 3/28* (2006.01)
*F23R 3/06* (2006.01)

(52) U.S. Cl.
CPC ..... *F23R 3/346* (2013.01); *F23R 3/286* (2013.01); *F23R 3/34* (2013.01); *F23R 3/06* (2013.01); *F23R 3/283* (2013.01)

(58) Field of Classification Search
CPC .. F23R 3/346; F23R 3/286; F23R 3/34; F23R 3/06; F23R 3/283
See application file for complete search history.

(56) References Cited

U.S. PATENT DOCUMENTS

2013/0298562 A1* 11/2013 Cai ..... F23R 3/346 60/737
2015/0285501 A1* 10/2015 DiCintio ..... F23R 3/346 60/740
2024/0288170 A1* 8/2024 Myers ..... F23R 3/286

* cited by examiner

*Primary Examiner* — Todd E Manahan
*Assistant Examiner* — Rene D Ford
(74) *Attorney, Agent, or Firm* — James Pemrick; Charlotte Wilson; Hoffman Warnick LLC

(57) ABSTRACT

An axial fuel stage (AFS) injector includes a mixing member and a high pressure (HP) air-fuel injection member. The injection member includes HP air-fuel injectors including an inner wall defining an inner air jet and an outer wall surrounding and concentric with the inner wall and defining an outer air jet loop therebetween. A spacer member spaces the walls. A plurality of fuel injector passages extends from the outer wall through the spacer member and the inner wall to the inner air jet. Each fuel injector passage has an end including a fuel injector directed into the inner air jet. A fuel plenum is configured to deliver a fuel to each of the fuel injectors. The inner air jets and the air jet loops are configured to direct a high-pressure air flow from a high-pressure air source with the fuel into the inlet of the mixing member.

20 Claims, 20 Drawing Sheets

FIG. 9 214,216

AXIAL FUEL STAGE INJECTOR CREATING AIR CURTAIN

GOVERNMENT RIGHTS

This application was made with government support under contract number DE-FE0032173 awarded by the Department of Energy. The US government has certain rights in the invention.

TECHNICAL FIELD

The disclosure relates generally to turbomachine combustors and, more specifically, to an axial fuel stage (AFS) injector that creates an air curtain downstream of fuel injectors, and a combustor and a gas turbine system including the same.

BACKGROUND

Gas turbine systems include a combustion section including a plurality of combustors in which fuel is combusted to create a flow of combustion gas that is converted to kinetic energy in a downstream turbine section. Current combustors include a head end fuel nozzle assembly for combusting fuel in a primary combustion zone and axial fuel stage (AFS) injectors for combusting fuel in a secondary combustion zone downstream of the primary combustion zone. Portions of an air supply, for example, from a compressor discharge casing, are delivered to the head end fuel nozzle assembly and the AFS injectors in various flow passages. Current AFS injectors present challenges relative to adequately mixing highly reactive fuels, like hydrogen, with air and to achieving desired low exhaust emissions and desired flame holding capability.

BRIEF DESCRIPTION

All aspects, examples and features mentioned below can be combined in any technically possible way.

An aspect of the disclosure includes an axial fuel stage (AFS) injector for a combustor of a gas turbine (GT) system, the AFS injector comprising: a mixing member including a mixing chamber defined therein, the mixing chamber having an inlet and an outlet, wherein the outlet is configured to be in fluid communication with a combustion chamber of the combustor; a high pressure (HP) air-fuel injection member including at least one row of HP air-fuel injectors for directing an air-fuel mixture into the mixing chamber, each HP air-fuel injector including: an inner wall defining an inner HP air jet therein; an outer wall surrounding and concentric with the inner wall, wherein the inner wall and the outer wall define an outer HP air jet loop therebetween; a spacer member spacing the inner wall from the outer wall; and a plurality of fuel injector passages extending from an outer surface of the outer wall, through the spacer member and the inner wall to the inner HP air jet, each fuel injector passage having a first end open at the outer surface of the outer wall and a second end including a fuel injector directed into the inner HP air jet defined by the inner wall; and a fuel plenum defined in the HP air-fuel injection member and in fluid communication with the first end of each fuel injector passage, the fuel plenum configured to deliver a fuel from a fuel source to each of the fuel injectors, wherein each inner HP air jet and each HP air jet loop are configured to direct a HP air flow from a HP air source with the fuel into the inlet of the mixing chamber.

Another aspect of the disclosure includes any of the preceding aspects, and the HP air-fuel injection member further includes a plurality of HP air inlet openings downstream of the at least one row of HP air-fuel injectors for directing another HP air flow into the air-fuel mixture and into the inlet of the mixing chamber.

Another aspect of the disclosure includes any of the preceding aspects, and the HP air flow also draws a low pressure (LP) air from a LP air source to direct the LP air with the HP air and the fuel into the inlet of the mixing chamber.

Another aspect of the disclosure includes any of the preceding aspects, and the HP air-fuel injection member further includes a plurality of HP air inlet openings downstream of the at least one row of HP air-fuel injectors for directing another HP air flow into the air-fuel mixture and into the inlet of the mixing chamber, and wherein the HP air flow also draws a low pressure (LP) air from a LP air source to direct the LP air with the HP air and the fuel into the inlet of the mixing chamber.

Another aspect of the disclosure includes any of the preceding aspects, and the fuel injector directed into the inner HP air jet in the inner wall of each fuel injector passage includes an elongated slot.

Another aspect of the disclosure includes any of the preceding aspects, and the inner HP air jet is elongated and includes a first end and a second end separated by a middle portion, and wherein each of the first end and the second end is narrower than the middle portion.

Another aspect of the disclosure includes any of the preceding aspects, and the HP air jet loop has opposing sides each with a first longitudinal end portion and a second longitudinal end portion separated by a middle longitudinal portion, and wherein each of the first longitudinal end portion and the second longitudinal end portion is narrower than the middle longitudinal portion on each of the opposing sides.

Another aspect of the disclosure includes any of the preceding aspects, and at least one row of HP air-fuel injectors includes a first row of HP air-fuel injectors and a second row of HP air-fuel injectors.

Another aspect of the disclosure includes any of the preceding aspects, and the at least one row of HP air-fuel injectors includes a first row of HP air-fuel injectors, a second row of HP air-fuel injectors and a third row of HP air-fuel injectors between the first row and second row of HP air-fuel injectors.

Another aspect of the disclosure includes any of the preceding aspects, and the HP air-fuel injectors of the third row of HP air-fuel injectors direct the air-fuel mixture in a direction parallel to the mixing chamber, and the first row and the second row of HP air-fuel injectors direct the air-fuel mixture at an acute angle to the direction parallel to the mixing chamber.

Another aspect of the disclosure includes any of the preceding aspects, and further comprising a plurality of diversion members between the inner wall and the outer wall adjacent an outlet of the HP air jet loop.

Another aspect of the disclosure includes any of the preceding aspects, and the mixing member includes a filter member upstream of the at least one row of HP air-fuel injectors.

Another aspect of the disclosure includes any of the preceding aspects, and the mixing member and the HP air-fuel injection member each include at least one mounting element configured to receive a fastener to couple the mixing member and the HP air-fuel injection member to a combustion liner that defines the combustion chamber.

Another aspect of the disclosure includes any of the preceding aspects, and the HP air source is in direct fluid communication with a compressor discharge of the GT system.

Another aspect of the disclosure includes a combustor for a gas turbine system, the combustor comprising: a combustor body including a combustion liner; and a plurality of axial fuel stage (AFS) injectors directed into the combustion liner, at least one AFS injector including: a mixing member including a mixing chamber defined therein, the mixing chamber having an inlet and an outlet, wherein the outlet is configured to be in fluid communication with a combustion chamber of the combustor; a high pressure (HP) air-fuel injection member including at least one row of HP air-fuel injectors for directing an air-fuel mixture into the mixing chamber, each HP air-fuel injector including: an inner wall defining an inner HP air jet therein; an outer wall surrounding and concentric with the inner wall, wherein the inner wall and the outer wall define an outer HP air jet loop therebetween; a spacer member spacing the inner wall from the outer wall; and a plurality of fuel injector passages extending from an outer surface of the outer wall, through the spacer member and the inner wall to the inner HP air jet, each fuel injector passage having a first end open at the outer surface of the outer wall and a second end including a fuel injector directed into the inner HP air jet defined by the inner wall; and a fuel plenum defined in the HP air-fuel injection member and in fluid communication with the first end of each fuel injector passage, the fuel plenum configured to deliver a fuel from a fuel source to each of the fuel injectors, wherein each inner HP air jet and each HP air jet loop are configured to direct a HP air flow from a HP air source with the fuel into the inlet of the mixing chamber.

Another aspect of the disclosure includes any of the preceding aspects, and the HP air-fuel injection member further includes a plurality of HP air inlet openings downstream of the at least one row of HP air-fuel injectors for directing another HP air flow into the air-fuel mixture and into the inlet of the mixing chamber.

Another aspect of the disclosure includes any of the preceding aspects, and the HP air flow also draws a low pressure (LP) air from a LP air source to direct the LP air with the HP air and the fuel into the inlet of the mixing chamber.

Another aspect of the disclosure includes any of the preceding aspects, and the inner HP air jet is elongated and includes a first end and a second end separated by a middle portion, and wherein each of the first end and the second end is narrower than the middle portion.

Another aspect of the disclosure includes any of the preceding aspects, and the HP air jet loop has opposing sides each with a first longitudinal end portion and a second longitudinal end portion separated by a middle longitudinal portion, and wherein each of the first longitudinal end portion and the second longitudinal end portion is narrower than the middle longitudinal portion on each of the opposing sides.

Another aspect of the disclosure includes a gas turbine (GT) system, comprising: a compressor section; a combustion section operatively coupled to the compressor section; and a turbine section operatively coupled to the combustion section, wherein the combustion section includes at least one combustor including: a combustor body including a combustion liner; a head end fuel nozzle assembly at a forward end of the combustor body; and a plurality of axial fuel stage (AFS) injectors directed into the combustor body downstream of the head end fuel nozzle assembly, at least one AFS injector including: a mixing member including a mixing chamber defined therein, the mixing chamber having an inlet and an outlet, wherein the outlet is configured to be in fluid communication with a combustion chamber of the combustor; a high pressure (HP) air-fuel injection member including at least one row of HP air-fuel injectors for directing an air-fuel mixture into the mixing chamber, each HP air-fuel injector including: an inner wall defining an inner HP air jet therein; an outer wall surrounding and concentric with the inner wall, wherein the inner wall and the outer wall define an outer HP air jet loop therebetween; a spacer member spacing the inner wall from the outer wall; and a plurality of fuel injector passages extending from an outer surface of the outer wall, through the spacer member and the inner wall to the inner HP air jet, each fuel injector passage having a first end open at the outer surface of the outer wall and a second end including a fuel injector directed into the inner HP air jet defined by the inner wall; and a fuel plenum defined in the HP air-fuel injection member and in fluid communication with the first end of each fuel injector passage, the fuel plenum configured to deliver a fuel from a fuel source to each of the fuel injectors, wherein each inner HP air jet and each HP air jet loop are configured to direct a HP air flow from a HP air source with the fuel into the inlet of the mixing chamber.

Two or more aspects described in this disclosure, including those described in this summary section, may be combined to form implementations not specifically described herein. That is, all embodiments described herein can be combined with each other.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which:

FIGS. 13A1-4, 13B1-4, 13C1-4 and 13D1-4 show various views of an HP air-fuel injector according to other embodiments of the disclosure;

Figure 1:
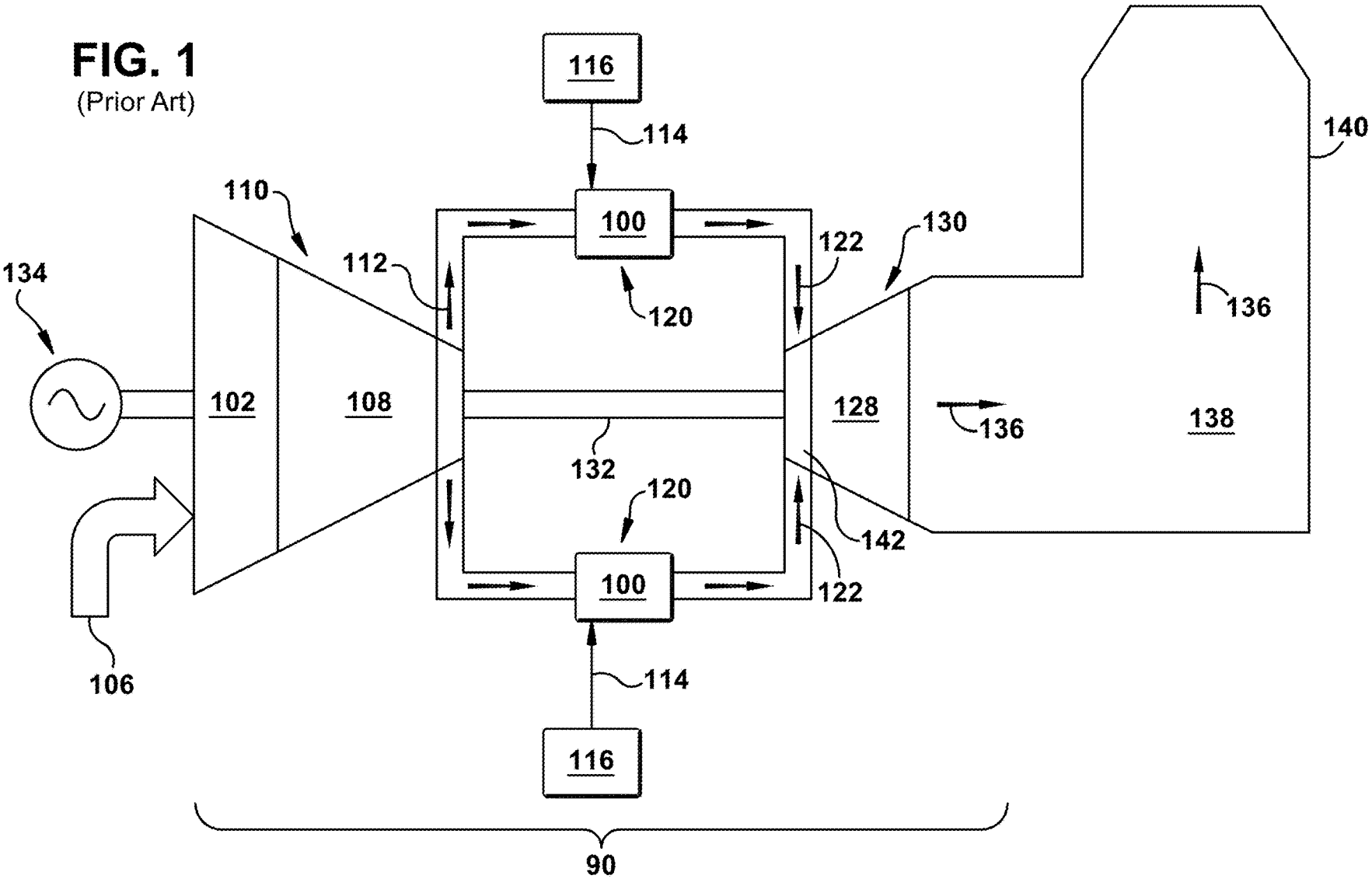
FIG. 1 (Prior Art)
FIG. 1 shows a functional block diagram of an illustrative gas turbine system capable of use with a combustor including an axial fuel stage (AFS) injector according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current technology, it will become necessary to select certain terminology when referring to and describing relevant machine components within the illustrative application of a turbomachine combustor and axial fuel stage (AFS) injector. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through a combustor of the turbomachine or, for example, the flow of air through the combustor or AFS injector, or coolant through one of the turbomachine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the turbomachine or combustor, and "aft" referring to the rearward or turbine end of the turbomachine or combustor.

The term "axial" refers to movement or position parallel to an axis, e.g., an axis of a combustor, a mixing chamber of the AFS injector, or turbomachine. The term "radial" refers to movement or position perpendicular to an axis, e.g., an axis of a combustor or a turbomachine. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. Finally, the term "circumferential" refers to movement or position around an axis, e.g., a circumferential interior surface of a combustor body or a circumferential interior of casing extending about a combustor. As indicated above and depending on context, it will be appreciated that such terms may be applied in relation to the axis of the combustor or the axis of the turbomachine.

In addition, several descriptive terms may be used regularly herein, as described below. The terms "first," "second," and "third," may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event may or may not occur or that the subsequently described feature may or may not be present and that the description includes instances where the event occurs, or the feature is present and instances where the event does not occur, or the feature is not present.

Where an element or layer is referred to as being "on," "engaged to," "connected to," "coupled to," or "mounted to" another element or layer, it may be directly on, engaged, connected, coupled, or mounted to the other element or layer, or intervening elements or layers may be present. In contrast, when an element is referred to as being "directly on," "directly engaged to," "directly connected to," or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The verb forms of "couple" and "mount" may be used interchangeably herein.

Embodiments of the disclosure provide an axial fuel stage (AFS) injector for a combustor, the combustor and a gas turbine (GT) system including the same. The AFS injector includes a mixing member having a mixing chamber defined therein. The mixing chamber includes an inlet and an outlet, and the outlet is configured to be in fluid communication with a combustion chamber of the combustor. A high pressure (HP) air-fuel injection member includes at least one row of HP air-fuel injectors for directing an air-fuel mixture into the mixing chamber. Each HP air-fuel injector includes an inner wall defining an inner HP air jet therein, and an outer wall surrounding and concentric with the inner wall. The inner wall and the outer wall define an outer HP air jet loop therebetween, and a spacer member spaces the inner wall from the outer wall. A plurality of fuel injector passages extends from an outer surface of the outer wall, through the spacer member and the inner wall to the inner HP air jet. Each fuel injector passage has a first end open at the outer surface of the outer wall and a second end including a fuel injector directed into the inner HP air jet defined by the inner wall. A fuel plenum is defined in the HP air-fuel injection member and in fluid communication with the first end of each fuel injector passage. The fuel plenum is configured to deliver a fuel from a fuel source to each of the fuel injectors. Each inner HP air jet and each HP air jet loop are configured to direct a HP air flow from a HP air source with the fuel into the inlet of the mixing chamber.

The HP air jet loop creates an air curtain to focus the HP, high velocity air in the wake behind where the fuel exits the fuel injectors to prevent flame attachment to the hardware. The inner HP jet and the HP air jet loop, among other things, can be tailored to produce the desired velocity profile. The mixing chamber directs the air-fuel mixture into the combustion liner for combustion in a secondary combustion zone thereof. The AFS injector may optionally mix up to three sources of air, two being high-pressure air, e.g., from a compressor discharge, and the other a low-pressure air, e.g., post-impingement cooling air, to reduce overall system pressure loss and more efficiently use air in the combustor. In any event, the AFS injector can rapidly premix the air source(s) with, for example, highly reactive fuels, like hydrogen, to achieve low emissions, e.g., of nitrous oxide (NOx), and an acceptable flame holding capability. The AFS injector also achieves high mixedness of fuel and air, minimizes flow-pressure loss, and prevents fuel from entering any low velocity air flow zones. Additionally, the AFS injector is packaged in a relatively small geometry, allowing it to be assembled onto the combustion liner of a combustor body, and the combustor body installed into the GT system through the relatively small opening in a compressor discharge casing. The AFS injector may be additively manufactured to include a plurality of parallel, sintered metal layers.

FIG. 1 shows a functional block diagram of an illustrative gas turbine (GT) system 90 that may incorporate various embodiments of a combustor 100 and axial fuel stage (AFS) injectors 150 (FIG. 2) of the present disclosure. As shown, GT system 90 generally includes an inlet section 102 that may include a series of filters, cooling coils, moisture separators, and/or other devices to purify and otherwise condition a working fluid (e.g., air) 104 entering GT system 90. Working fluid 106, i.e., air, flows to a compressor 108 in a compressor section 110 that progressively imparts kinetic energy to working fluid 106 to produce a compressed, high-pressure (HP) air 112 (hereafter "HP air 112" or "compressed air 112") at a highly energized state. HP air 112 is typically mixed with a fuel 114A and/or 114B from a fuel source 116 to form a combustible mixture within at least one combustor 100 in a combustion section 120 that is operatively coupled to compressor section 110. The combustible mixture is burned to produce combustion gases 122 having a high temperature and pressure.

Combustion gases 122 flow through a turbine 128 (i.e., an expansion turbine) of a turbine section 130 operatively coupled to combustion section 120 to produce work. For example, turbine 128 may be connected to a shaft 132 so that rotation of turbine 128 drives compressor 108 to produce HP air 112. Alternately, or in addition, shaft 132 may connect turbine 128 to another load, such as a generator 134 for producing electricity. Exhaust gases 136 from turbine 128 flow through an exhaust section 138 that connects turbine 128 to an exhaust stack 140 downstream from turbine 128. Exhaust section 138 may include, for example, a heat recovery steam generator (not shown) for cleaning and extracting additional heat from exhaust gases 136 prior to release to the environment. Where more than one combustor 100 is used, they may be circumferentially spaced around a turbine inlet 142 of turbine 128.

In one embodiment, GT system 90 may include an engine model commercially available from GE Vernova of Cambridge, MA. The present disclosure is not limited to any one particular GT system and may be implemented in connection with other engines including, for example, any HA, F, B, LM, GT, TM and E-class engine models of GE Vernova, and engine models of other companies. Furthermore, the present disclosure is not limited to implementation within any particular turbomachine, and may be applicable to, for example, steam turbines, jet engines, compressors, turbofans, etc.

Figure 2:
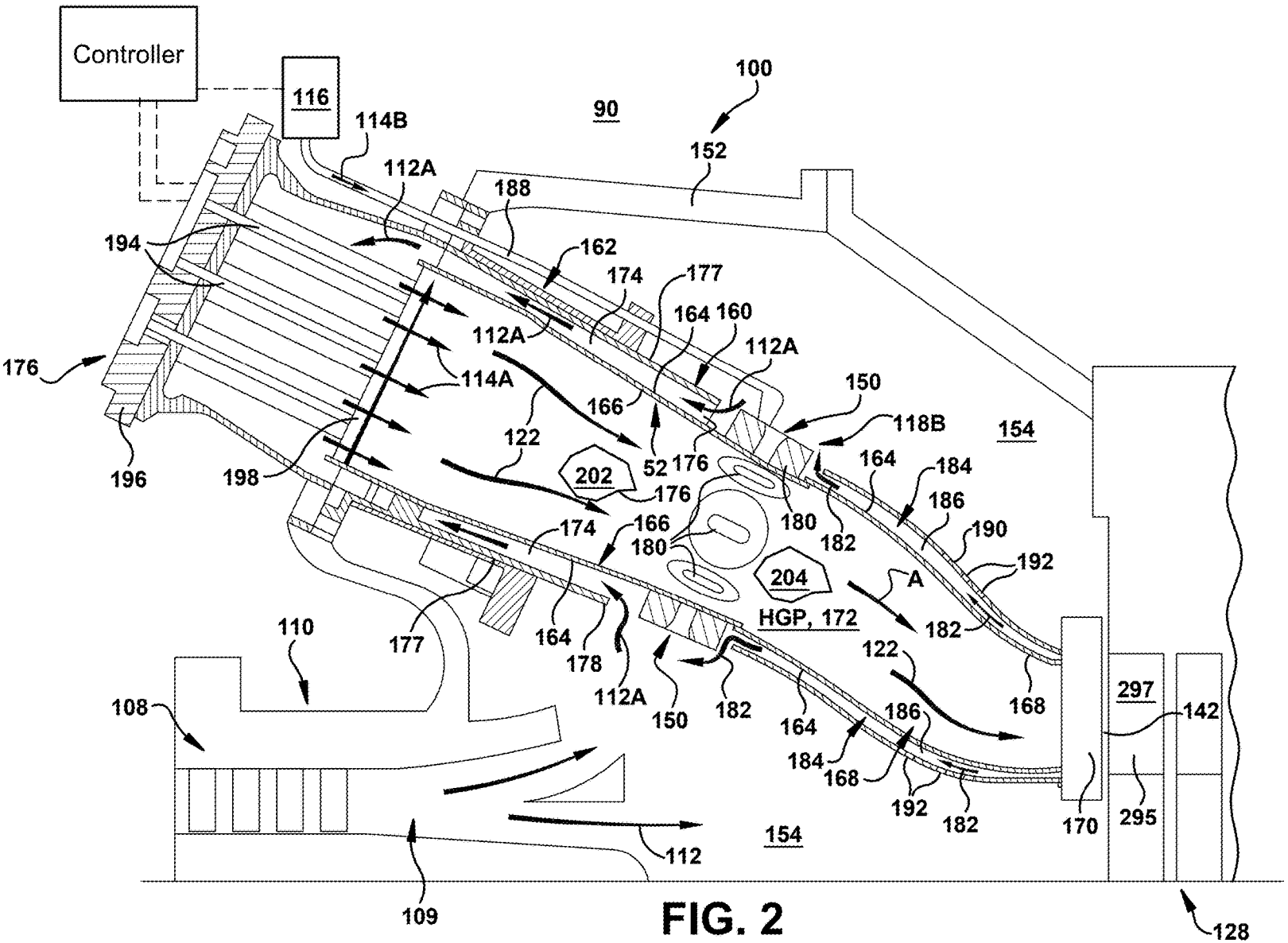
FIG. 2 shows a cross-sectional side view of a combustor including an AFS injector according to embodiments of the disclosure.

A combustor 100 usable within GT system 90 will now be described. FIG. 2 shows a cross-sectional side view of combustor 100 positioned within GT system 90. As will be further described herein, combustor 100 may include one or more axial stage fuel (AFS) injectors 150 according to embodiments of the disclosure.

As shown in FIG. 2, combustor 100 is at least partially surrounded by an outer casing 152 such as a compressor discharge casing and/or a turbine casing. An interior of outer casing 152 is in fluid communication with a compressor discharge 109 of compressor 108 and creates an HP air source 154. That is, HP air source 154 includes HP air 112 from a compressor discharge 109 of compressor 108. HP source 154 is in direct fluid communication with compressor discharge 109 of GT system 90. However, HP air source 154 may be any supply of HP air 112 capable of flowing into any variety of openings or flow passages in combustor 100 to cool parts and/or for combustion, i.e., in AFS injectors 150.

As shown in FIG. 2, combustor 100 for GT system 90 includes a combustor body 160. Combustor body 160 may be made using any now known or later developed techniques. For example, combustor body 160 may be additively manufactured. Combustor body 160 may include a combustion liner 164, which may include, for example, a cylindrical portion 166 and a tapered transition portion 168. Combustion liner 164 may have an axis A, the direction of which may vary slightly depending on axial location within the curved combustion liner 164. Tapered transition portion 168 is at an aft end (right side as shown in FIG. 2) of cylindrical portion 166. As understood in the field, tapered transition portion 168 transitions the hot gas path (HGP) from the circular cross-section of the liner's cylindrical portion 166 to a more arcuate cross-section for mating with turbine inlet 142 of turbine 128. Combustor 100 may also include an aft frame 170 at an aft end (right side in FIG. 2) of tapered transition portion 168.

Combustion liner 164 may contain and convey combustion gases 122 to turbine section 130 (FIG. 1). More particularly, combustion liner 164 defines a combustion chamber 172, i.e., in a hot gas path (HGP), within which combustion occurs. Combustion liner 164 may have tapered transition portion 168 that is separate from cylindrical portion 166, as in many conventional combustion systems. Alternatively, as shown in FIG. 2, combustion liner 164 may have a unified body (or "unibody") construction, in which cylindrical portion 166 and tapered transition portion 168 are integrated with one another, i.e., as part of an additively manufactured one-piece member. Thus, any discussion of combustion liner 164 herein is intended to encompass both conventional combustion systems having a separate cylindrical and tapered transition portions and those combustion systems having a unibody liner.

Combustor body 160 also includes an air flow passage 174 defined at least partially by cylindrical portion 166 of combustion liner 164. As will be described herein, air flow passage 174 is configured to deliver air (e.g., HP air 112A from HP air source 154) to a head end fuel nozzle assembly 176 (hereinafter "head end assembly 176" for brevity) of combustor 100 at a forward end (left end in FIG. 2) of combustion liner 164. That is, it is sized, shaped and/or arranged to deliver air, such as HP air 112A from HP air source 154 to head end assembly 176 of combustor 100. Air flow passage 174 may be defined wholly within cylindrical portion 166, or air flow passage 174 may be provided between cylindrical portion 166 and a flow sleeve 177 spaced along at least a portion of an exterior surface of cylindrical portion 166. Air flow passage 174 has an open end 178, or air flow opening(s), proximate to head end assembly 176 through which HP air 112A from HP air source 154 enters. Here, HP air 112A from HP air source 154 may be pulled directly from compressor discharge 109, i.e., without any other use of the air other than coincidental convection cooling of combustor body 160.

An annular partition 179 disposed between cylindrical portion 166 and flow sleeve 177 separates a forward portion of air flow passage 174 from an aft portion of air flow passage 174. The axial position of annular partition 179 is approximately aligned with a cap assembly 198, discussed below, such that the forward portion of air flow passage 174 is radially outward of head end assembly 176 (rather than combustion chamber 172) and, therefore, requires less cooling. Aftward of annular partition 179, flow sleeve 177 may include a plurality of impingement holes 192 (as shown in outer sleeve 190), which permit HP air 112B to flow into air flow passage 174. As a result of passing through impingement holes 192, HP air 112B experiences a pressure drop and becomes LP air 182, which flows through air flow passage 174 toward and/or into AFS injector(s) 150, as discussed further herein.

Head end assembly 176 generally includes at least one axially extending fuel nozzle 194 that extends downstream from an end cover 196 and a cap assembly 198, which extends radially and axially within outer casing 152 downstream from end cover 196 and which defines the forward boundary of combustion chamber 172. Head end assembly 176 may include any now known or later developed axially extending fuel nozzles 194 for delivering first fuel 114A to a primary combustion zone 202 from axially extending fuel nozzles 194. In certain embodiments, axially extending fuel nozzle(s) 194 of head end assembly 176 extend at least partially through cap assembly 198 to provide a combustible mixture of fuel 114A and HP air 112A to primary combustion zone 202.

Combustor body 160 also includes an axial fuel stage (AFS) injector opening or seat 180 directed into combustion liner 164 downstream of head end assembly 176. Opening or seat 180 extends through a wall of combustion liner 164. One or more AFS injector openings or seats 180 (hereafter "openings 180") can be provided and are configured to have an AFS injector 150 mounted thereto and receive HP air 112B from HP air source 154, among possible other air flow(s) as will be described herein. Each AFS injector opening 180 may include any necessary structure to allow an AFS injector 150 to be mounted thereto, e.g., threaded fasteners, bolt holes, weld area, etc. As illustrated, combustor 100 and combustor body 160 may include a plurality of circumferentially spaced AFS injector openings 180 and corresponding AFS injectors 150. Any number of AFS injectors 150 can be used.

As will be described, in some embodiments, AFS injector (s) 150 may also be configured to receive (draw in) a low-pressure (LP) air 182 from a low-pressure (LP) air source 184, e.g., cooling passage, and direct it into combustion liner 164 with fuel 114B. Fuel 114B may be delivered from fuel source 116 using any form of fuel line(s) 188. Fuel 114A, 114B may be any now known or later developed combustor 100 fuels, such as but not limited to fuel oil, natural gas, hydrogen, and/or blends thereof. Fuels 114A, 114B may be the same or different.

In some embodiments, LP air 182 can be delivered to AFS injector(s) 150 in a variety of ways from LP air source 184. In certain embodiments, LP air 182 originates from HP air source 154 but is used for cooling prior to use in AFS injector(s) 150. In one example, combustor body 160 further includes a cooling passage(s) 186 at least partially defined by tapered transition portion 168. In this setting, cooling passage(s) 186 constitute LP air source 184. Cooling passage(s) 186 may also be in fluid communication with other cooling passages (not shown) in combustor 100, e.g., in an aft frame 170. In any event, LP air 182 of LP air source 184 may be used for cooling one or more hot parts of combustor 100. More particularly, LP air 182 of LP air source 184 passes through cooling passage(s) 186, which may be at least partially defined by tapered transition portion 168, after being pulled from compressor discharge 109.

In one example, cooling passage(s) 186 may be formed by a flow sleeve 190 surrounding tapered transition portion 168. Where desired, impingement cooling holes 192 may be provided in flow sleeve 190 or tapered transition portion 168 to allow HP air 112 to enter from HP air source 154 and become LP air 182. In this regard, LP air source 184 includes cooling passage(s) 186 defined along at least a portion of combustion liner 164, e.g., tapered transition portion 168, and any upstream cooling passages in other hot parts of combustor 100. Further, cooling passage(s) 186 may be downstream of an impingement cooling member (portion 168 with impingement cooling holes 192 in outer sleeve thereof or sleeve 190 around portion 168 with holes 192 therein) which is in direct fluid communication with compressor discharge 109 of GT system 90, i.e., HP air source 154. It is noted that the hot part(s) may include any part of combustor 100 requiring cooling, and LP air 182 may be directed to enter cooling passage(s) 186 in any manner desired. That is, cooling passage(s) 186 may be defined in or along (other) hot part(s) of combustor 100 other than tapered transition portion 168, e.g., aft frame 170. LP air source 184 may also be considered to be in fluid communication with cooling passage 186 defined along at least a portion of combustion liner 164 of combustor 100. In any event, cooling passage(s) 186 is/are between AFS injector(s) 150 and HP air source 154 with the cooling passage(s) 186, in some embodiments, being configured to deliver LP air 182 of LP air source 184 to AFS injector(s) 150. LP air 182 from LP air source 184 may also be referred to herein as a "post-cooling" or "post-impingement air" since it is used to provide significant cooling of parts of combustor 100.

As noted, combustor 100 includes at least one axial fuel stage (AFS) injector 150 directed into combustor body 160, i.e., combustion liner 164. As noted, AFS injector(s) 150 may include a plurality of AFS injectors 150 circumferentially spaced around combustor body 160. Each AFS injector 150 extends radially toward an opening 180 in combustion liner 164 downstream from head end assembly 176, i.e., downstream from axially extending fuel nozzle(s) 194. As will be further described, AFS injectors 150 are configured to receive HP air 112B of HP air source 154 and second fuel 114B for combustion in a secondary combustion zone 204 that is downstream from primary combustion zone 202. In certain embodiments, AFS injectors 150 may optionally draw in LP air 182 from LP air source 184. In this latter case, LP air 182 of LP air source 184 may be routed to AFS injector(s) 150, e.g., in cooling passage(s) 186, to combine with HP air 112B and second fuel 114B for combustion in a secondary combustion zone 204 that is downstream from primary combustion zone 202.

Figure 3:
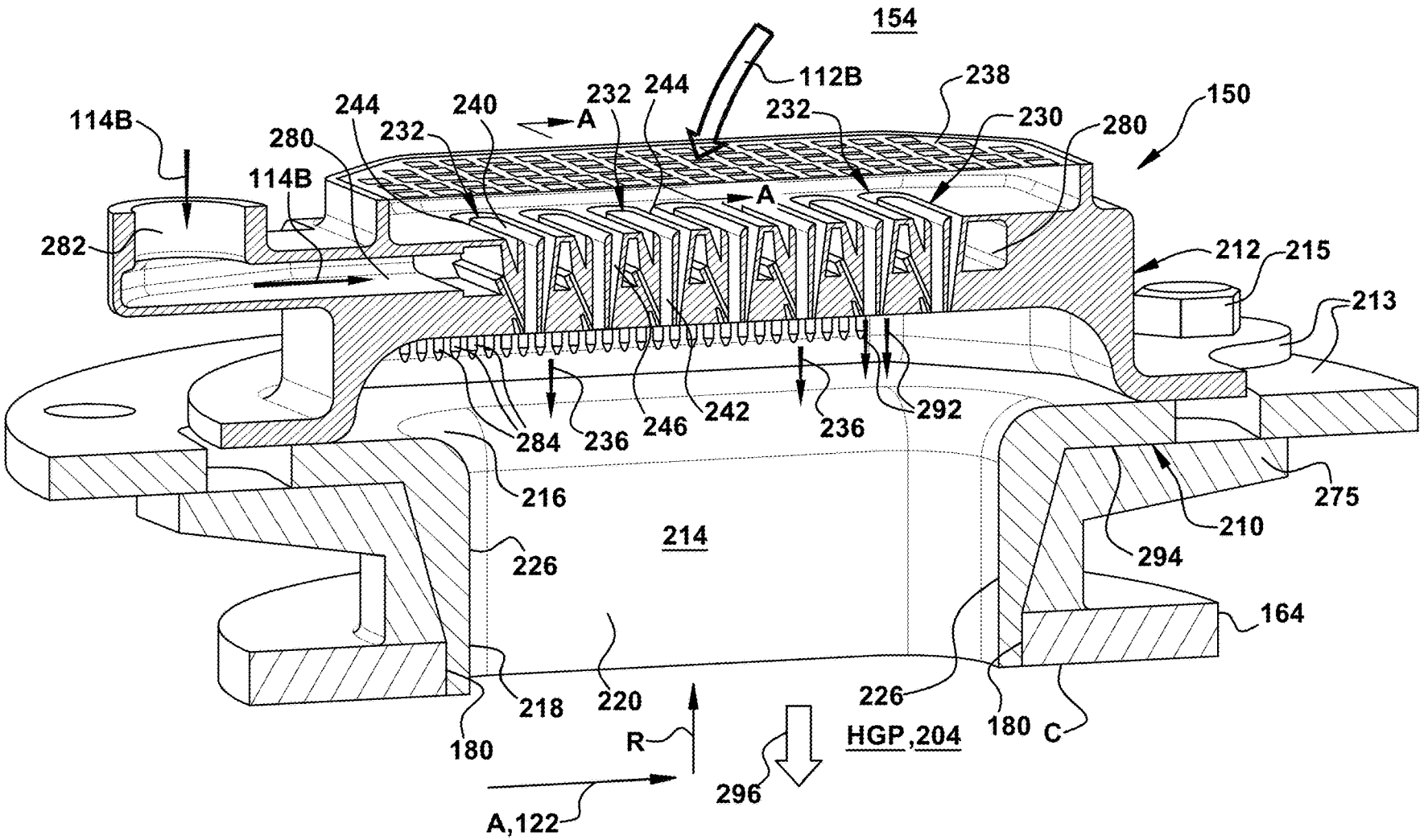
FIG. 3 shows a perspective and partial cross-sectional view of an AFS injector according to embodiments of the disclosure.
Figure 4:
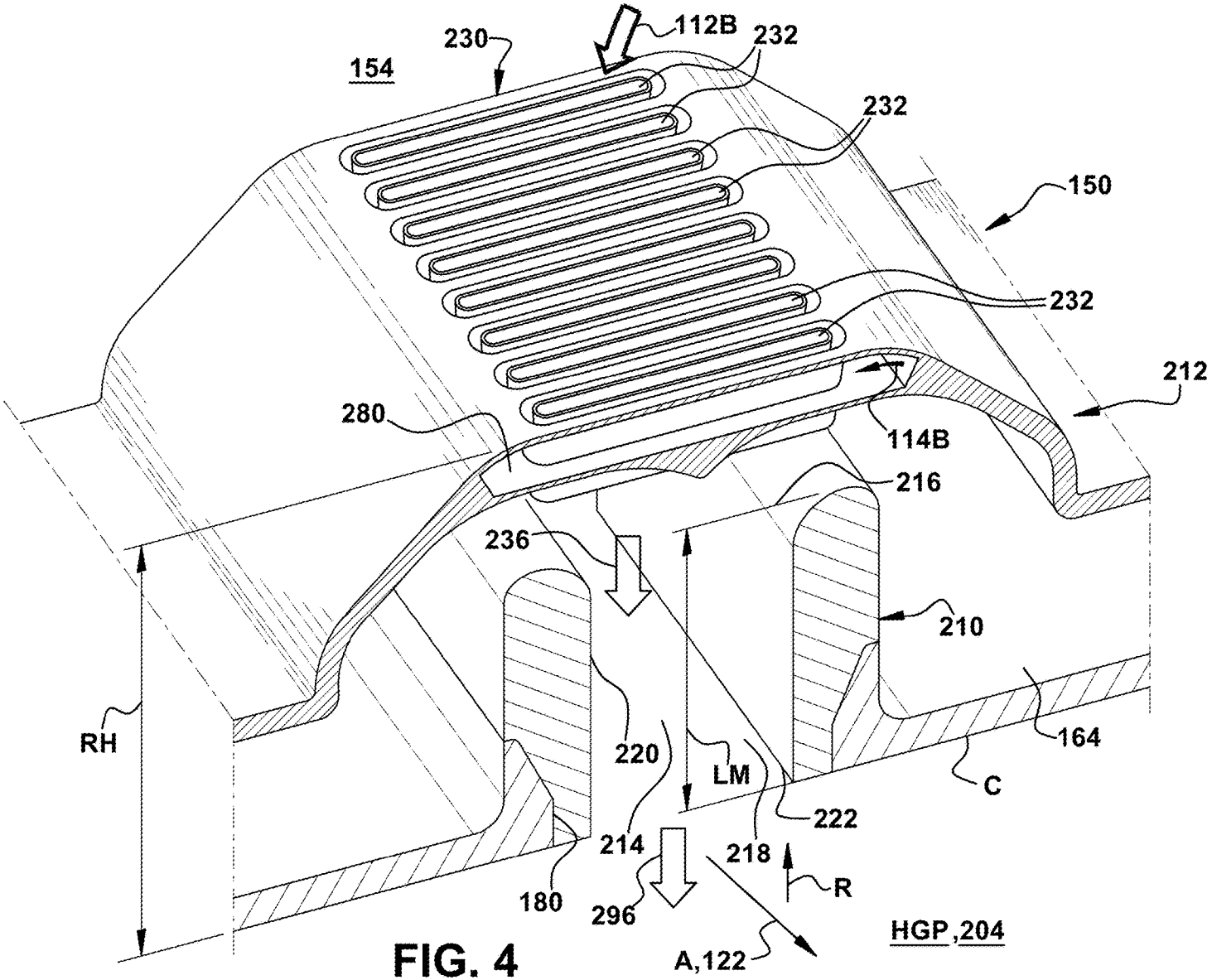
FIG. 4 shows a perspective and partial cross-sectional view along view line A-A of FIG. 3 according to embodiments of the disclosure.
Figure 5:
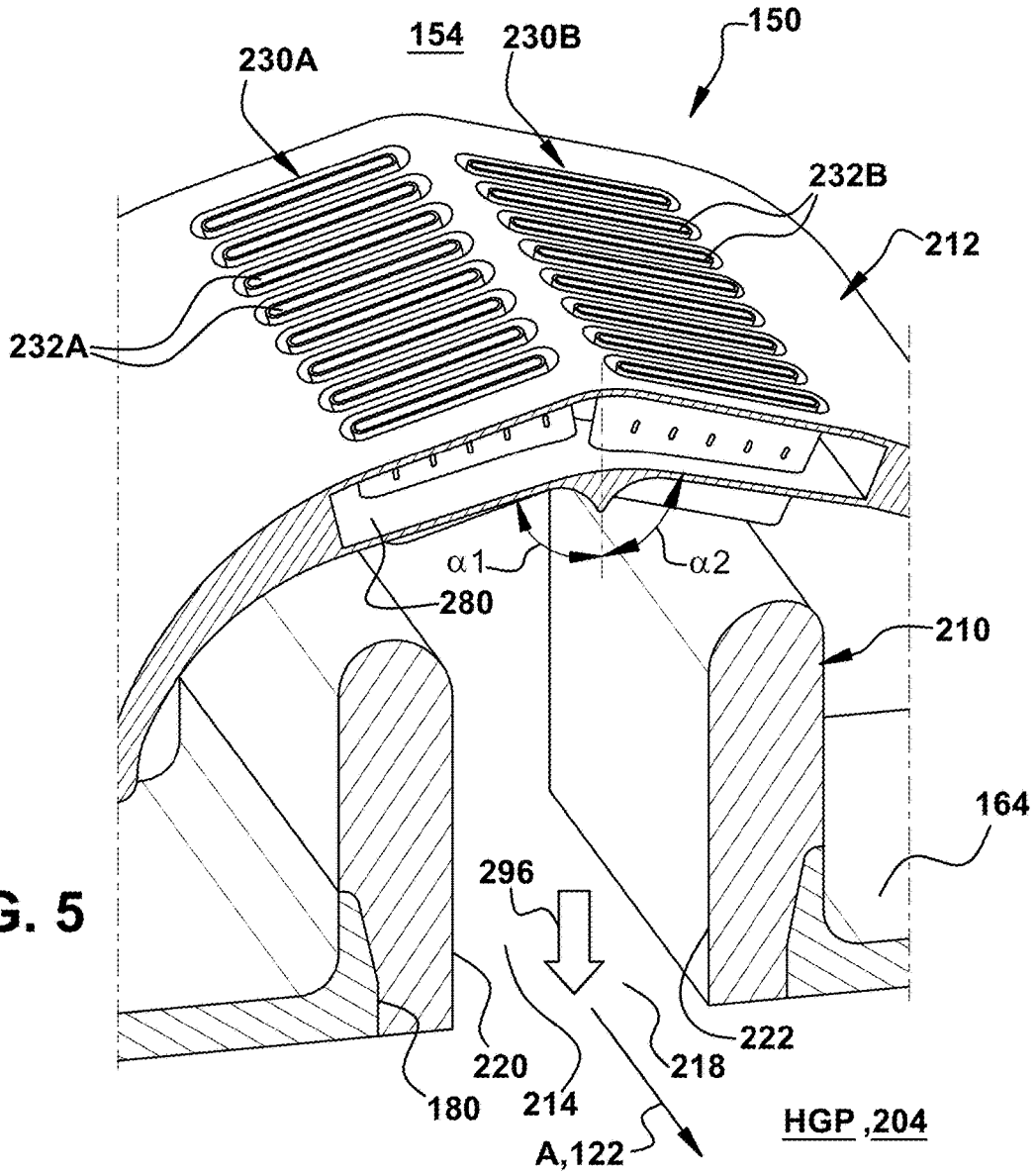
FIG. 5 shows a perspective and partial cross-sectional view similar to FIG. 4 according to other embodiments of the disclosure.
Figure 6:
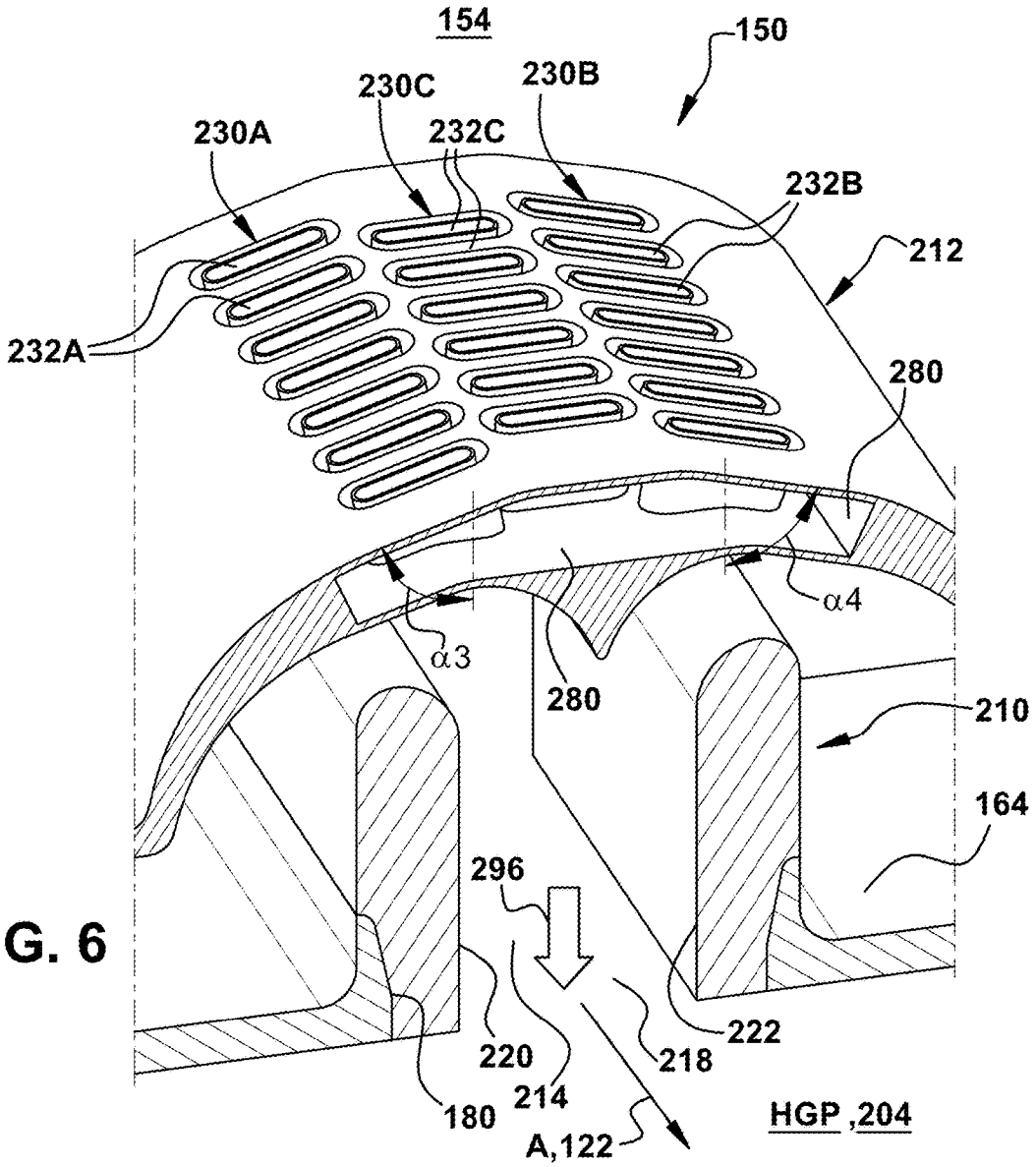
FIG. 6 shows a perspective and partial cross-sectional view similar to FIG. 4 according to additional embodiments of the disclosure.

FIG. 3 shows a perspective and partial cross-sectional view of AFS injector 150, and FIG. 4 shows a perspective and partial cross-sectional view along view line A-A of FIG. 3 according to embodiments of the disclosure. Also, FIG. 5 shows a perspective and partial cross-sectional view similar to FIG. 4 according to other embodiments, and FIG. 6 shows a perspective and partial cross-sectional view similar to FIG. 4 according to additional embodiments. AFS injector 150 includes a mixing member 210 and a high pressure (HP) air-fuel injection member 212. Mixing member 210 and HP air-fuel injection member 212 are coupled together to form AFS injector 150. More particularly, as shown in FIG. 3, mixing member 210 and HP air-fuel injection member 212 may each include at least one mounting element 213 configured to receive a fastener 215 (e.g., bolt, weld or other fastener) to couple mixing member 210 and HP air-fuel injection member 212 to combustion liner 164 (e.g., to flow sleeve 190) that defines combustion chamber 172 (FIG. 2), e.g., to AFS injector mounts 275 of combustion liner 164. Alternatively, mixing member 210 and HP air-fuel injection member 212 may be formed as a single, integrated piece, e.g., by additive manufacturing. Each AFS injector 150 is aligned with a respective opening 180 in combustion liner 164. Hereafter, HP air-fuel injection member 212 is sometimes referred to as "injection member 212" for brevity.

As shown in FIG. 3-4, mixing member 210 includes a mixing chamber 214 defined therein. Mixing chamber 214 includes an inlet 216 and an outlet 218. Inlet 216 is radially inward of HP air-fuel injection member 212 and outlet 218. Outlet 218 is configured to be in fluid communication with combustion liner 164 of combustor 100 (FIG. 2). Outlet 218 may be defined by mixing member 210 and may have any cross-sectional shape. In one example, outlet 218 has an axially-elongated slot cross-sectional shape, but it may have different shapes. In any event, mixing member 210 at outlet 218 may be positioned and fixed in opening 180 in combustion liner 164. Outlet 218 may be flush with an interior surface of combustion liner 164 or may be positioned inward of combustion liner 164.

Mixing chamber 214 may take a variety of forms. More particularly, as shown in FIGS. 3-4, mixing chamber 214 may be axially elongated and have generally elongated chamber with elongated opposing walls 220, 222 and opposing ends 226. Mixing chamber 214 is referred to as "axially-elongated" because the longitudinal length thereof may be generally aligned with an axis A of combustion liner 164 and the longitudinal length thereof may be generally greater than the circumferential width thereof. As shown in FIG. 3, opposing ends 226 may be rounded as they transition to respective opposing walls 220, 222. That is, two opposing sidewalls 220, 222 and opposing ends 226 are connected together to collectively have an oval or elliptical cross-sectional shape. Although not shown, some curvature and/or narrowing from inlet 216 to outlet 218 may be provided in mixing chamber 214, where desired. Mixing chamber 214 may extend radially relative to a circumference C of combustion liner 164. Mixing chamber 214 extends radially relative to axis A of combustion liner 164, i.e., along a particular radial direction R. Dimensions of mixing chamber 214 can be user defined based on among many other factors: characteristics of fuel 114B, HP air 112, LP air 182 (if used), and/or combustion liner 164. As shown in FIG. 4, length LM of mixing chamber 214 from inlet 216 to outlet 218 can be user-defined. The dimensions of any part of mixing member 210 (and HP air-fuel injection member 212) of AFS injectors 150 may be customized to create a desired (final) air-fuel mixture 296 (FIG. 3) to be generated thereby. Additionally, a radial height RH from a radially outermost (top) surface of injection member 212 to a radially inner surface of combustion liner 164 may be optimized to facilitate installation of combustion liner 164 (with AFS injectors 150 mounted thereon) through openings in combustor casing.

With continuing reference to FIGS. 3-6, HP air-fuel injection member 212 will now be described. It is noted that HP air-fuel injection member 212 may also be referred to as a "top hat." HP air-fuel injection member 212 includes at least one row 230 of HP air-fuel injectors 232 for directing an (initial) air-fuel mixture 236 into mixing chamber 214. In FIGS. 3 and 4, one row 230 of HP air-fuel injectors 232 are shown. FIG. 5 shows a perspective and partial cross-sectional view of an AFS injector 150 with two rows 230A-B of HP air-fuel injectors 232. That is, the at least one row 230 of HP air-fuel injectors 232 includes a first row 230A of HP air-fuel injectors 232A and a second row 230B of HP air-fuel injectors 232B. FIG. 6 shows a perspective and partial cross-sectional view of an AFS injector 150 with three rows 230A-C of HP air-fuel injectors 232. More particularly, the at least one row 230 of HP air-fuel injectors 232 includes a first row 230A of HP air-fuel injectors 232A, a second row 230B of HP air-fuel injectors 232B, and a third row 230C of HP air-fuel injectors 232C between first row 230A and second row 230B of HP air-fuel injectors 232A, 232B.

Figure 15:
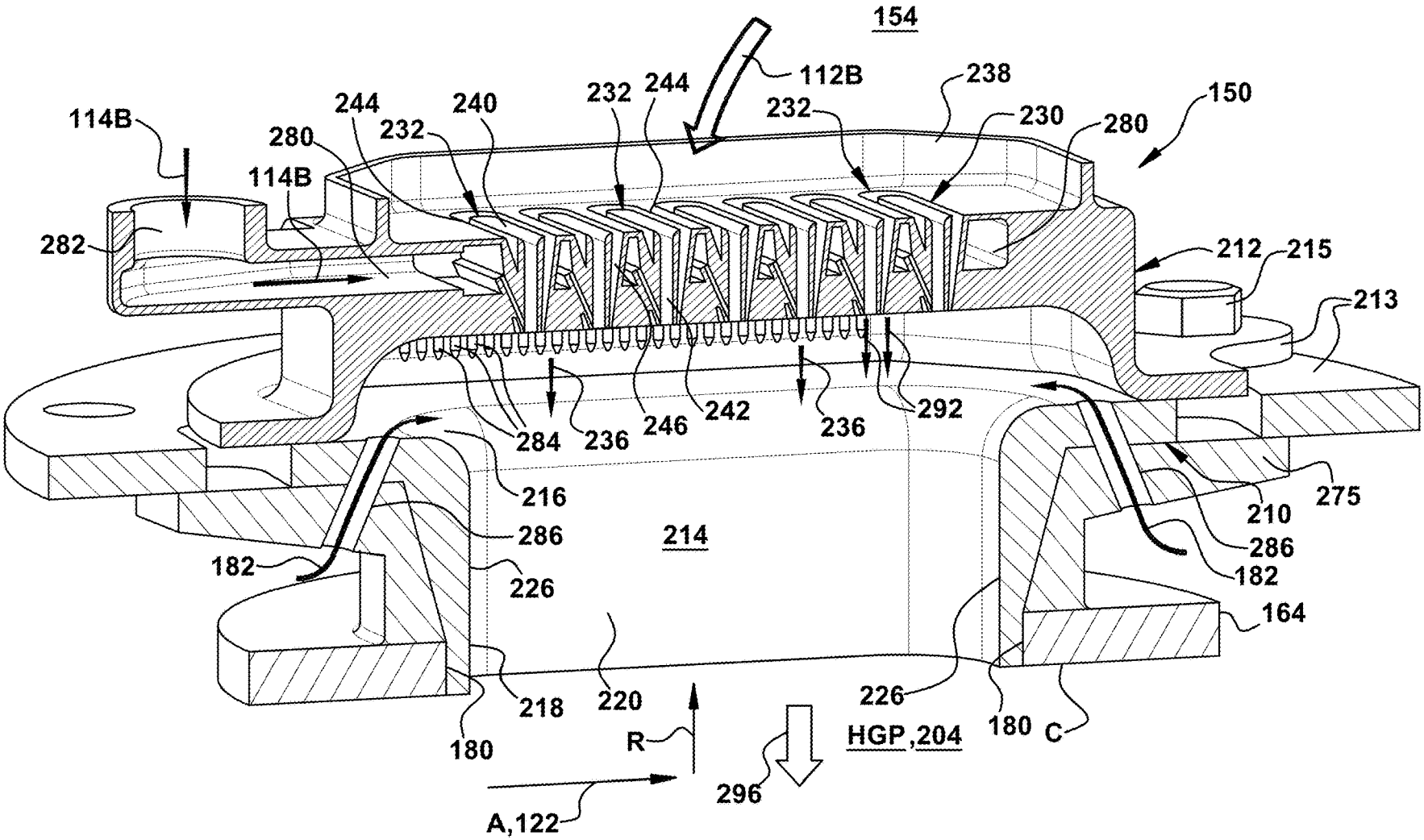
FIG. 15 shows a perspective and partial cross-sectional view of an AFS injector according to other embodiments of the disclosure.

The rows 230 of HP air-fuel injectors 232 may be angled in any manner to encourage mixing of fuel 114B and HP air 112B (and LP air 182 where provided) to form air-fuel mixture 236. For example, as shown in FIG. 5, first row 230A and second row 230B of HP air-fuel injectors 232A, 232B, respectively, may be set at acute angles $\alpha 1$, $\alpha 2$, respectively, relative to radial direction R in a manner to direct air-fuel mixture 236 into mixing chamber 214. The angles $\alpha 1$, $\alpha 2$ of rows 230A, 230B may be equal or different. Similarly, as shown in FIG. 6, third row 230C of HP air-fuel injectors 232C may direct air-fuel mixture 236 in a direction parallel to mixing chamber 214, i.e., in radial direction R, and first row 230A and second row 230B of HP air-fuel injectors 232A, 232B may direct air-fuel mixture 236 at an acute angle $\alpha 3$, $\alpha 4$, respectively, relative to the direction parallel to mixing chamber 214, i.e., relative to radial direction R. The angles $\alpha 3$, $\alpha 4$ of rows 230A, 230B may be equal or different. FIG. 15 shows a perspective and partial cross-sectional view of an AFS injector 150, similar to FIG. 3, but using LP air 182, according to other embodiments of the disclosure. As shown in FIG. 15, where LP air 182 is provided, row(s) 230 of HP air-fuel injectors 232 may be aimed to direct air-fuel mixtures 236 exiting therefrom to draw LP air 182 into air-fuel mixture 236.

Figure 7:
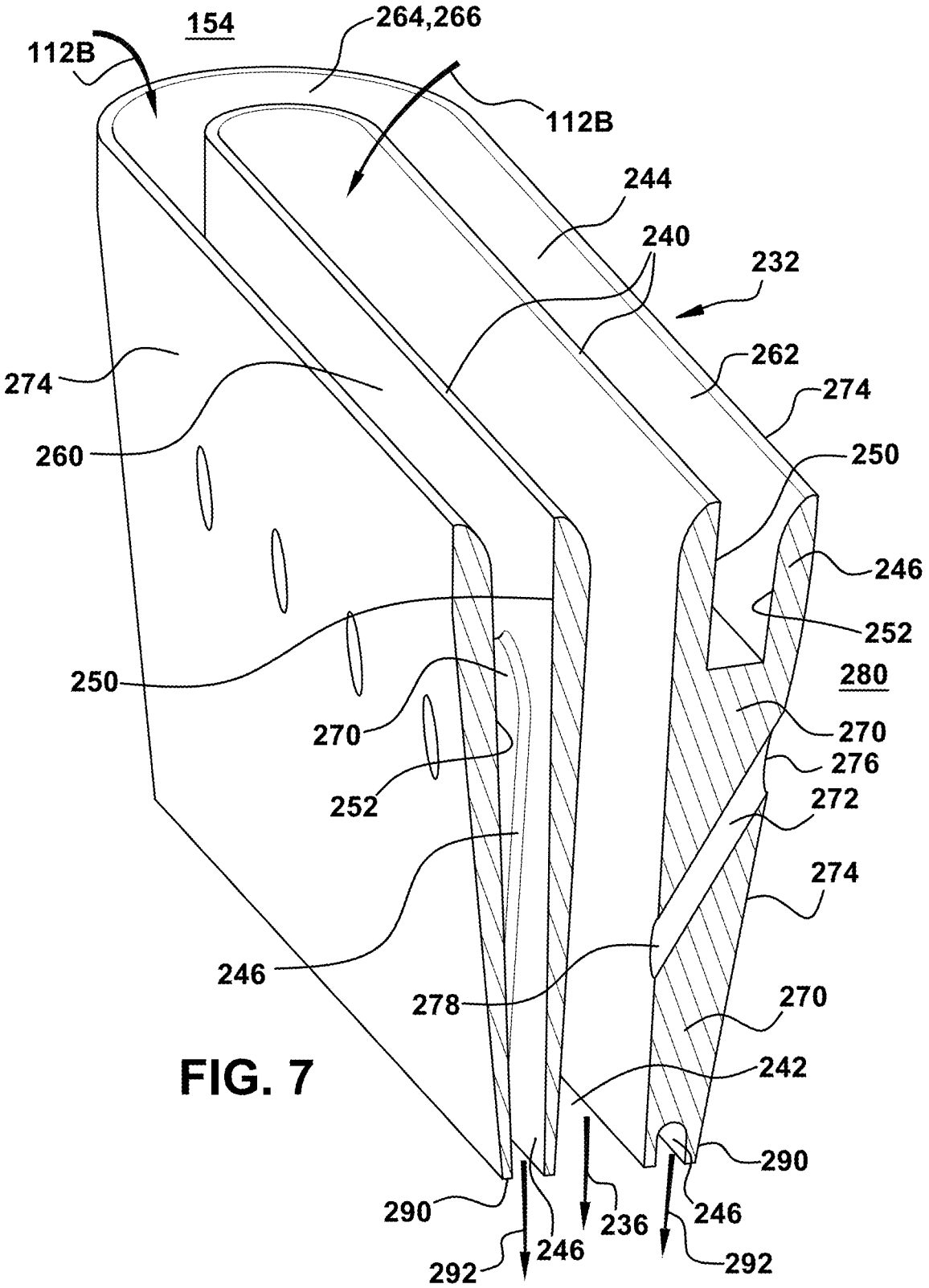
FIG. 7 shows a schematic cross-sectional perspective view of a high-pressure (HP) air-fuel injector according to embodiments of the disclosure.
Figure 8:
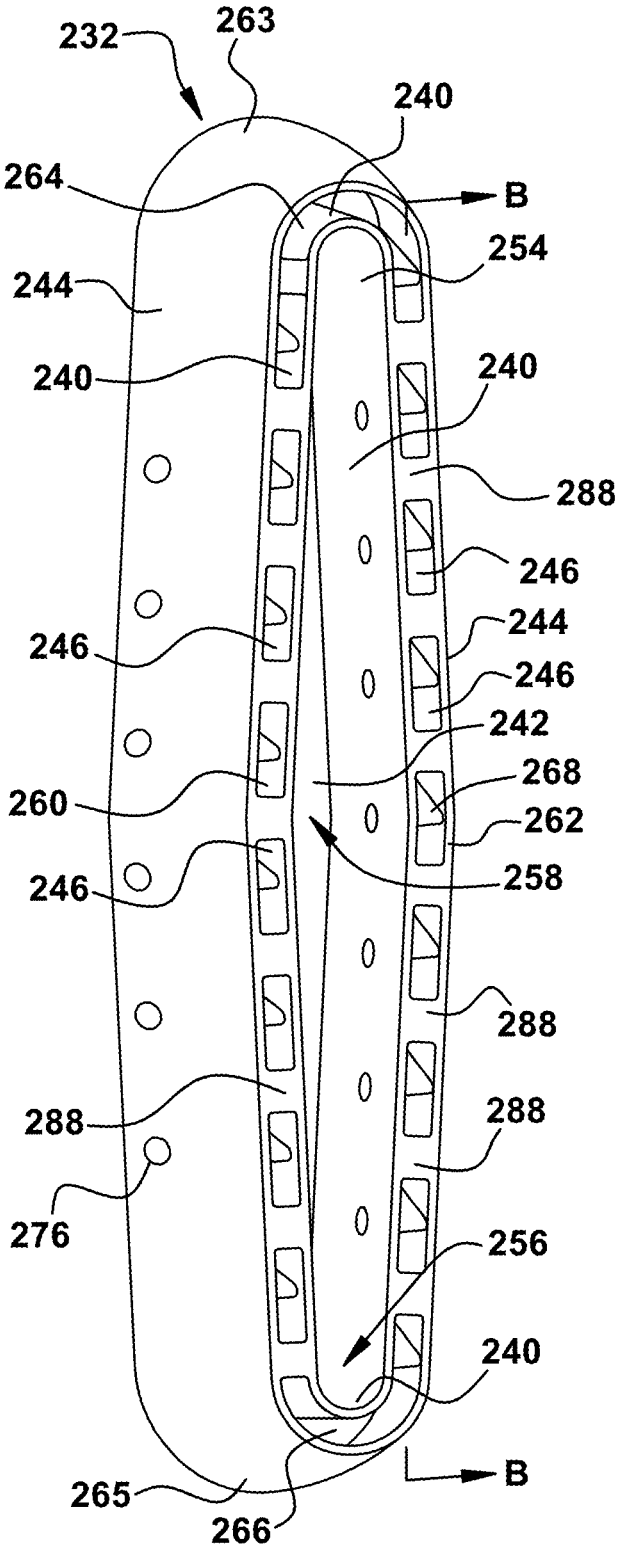
FIG. 8 shows a schematic bottom-up view of an HP air-fuel injector according to embodiments of the disclosure.
Figure 10:
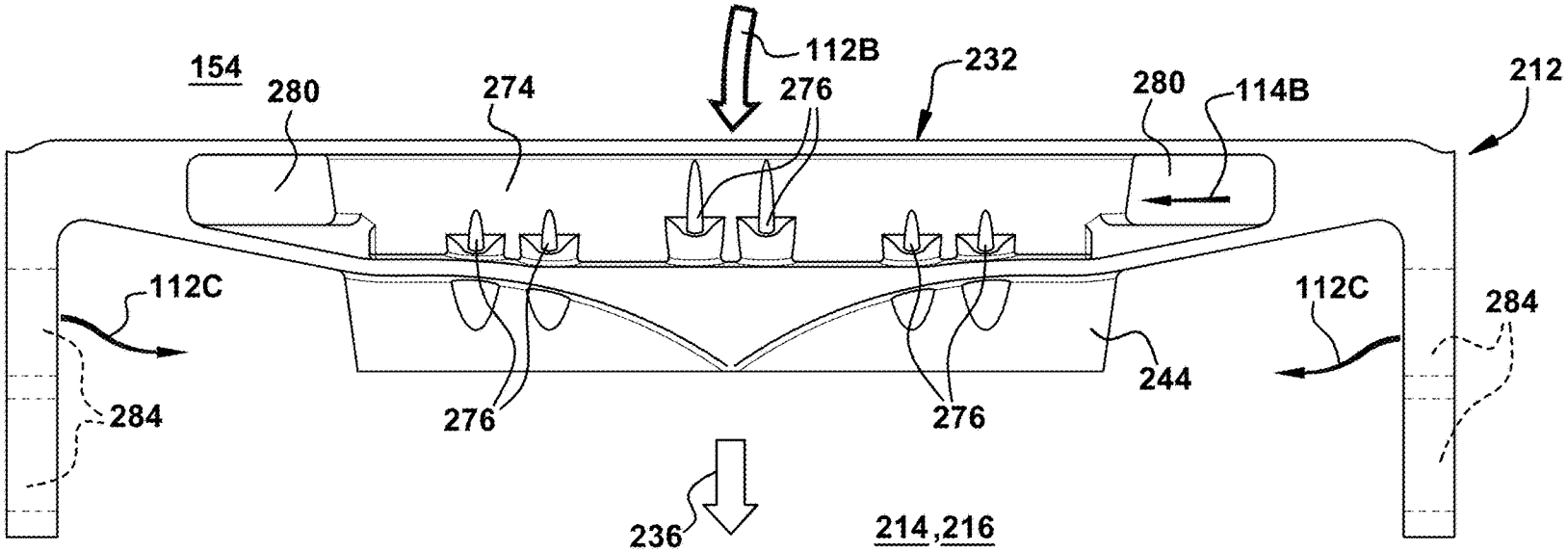
FIG. 10 shows a side view of the HP air-fuel injector in FIG. 9.
Figure 11:
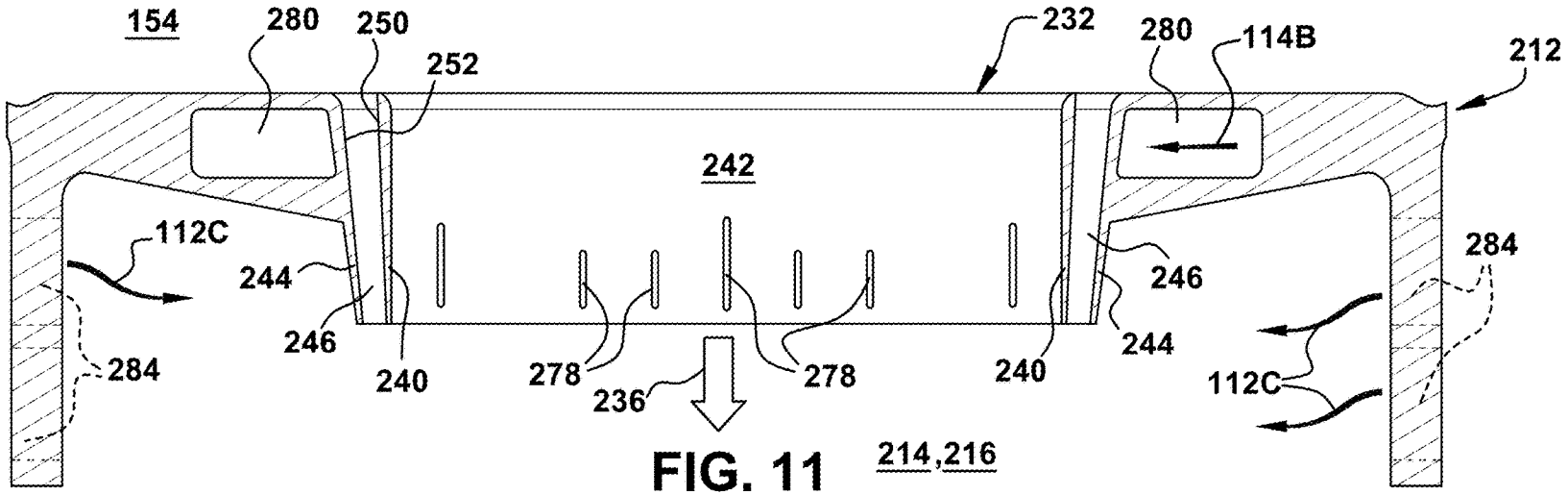
FIG. 11 shows a cross-sectional view along view line 11-11 in FIG. 9.
Figure 12:
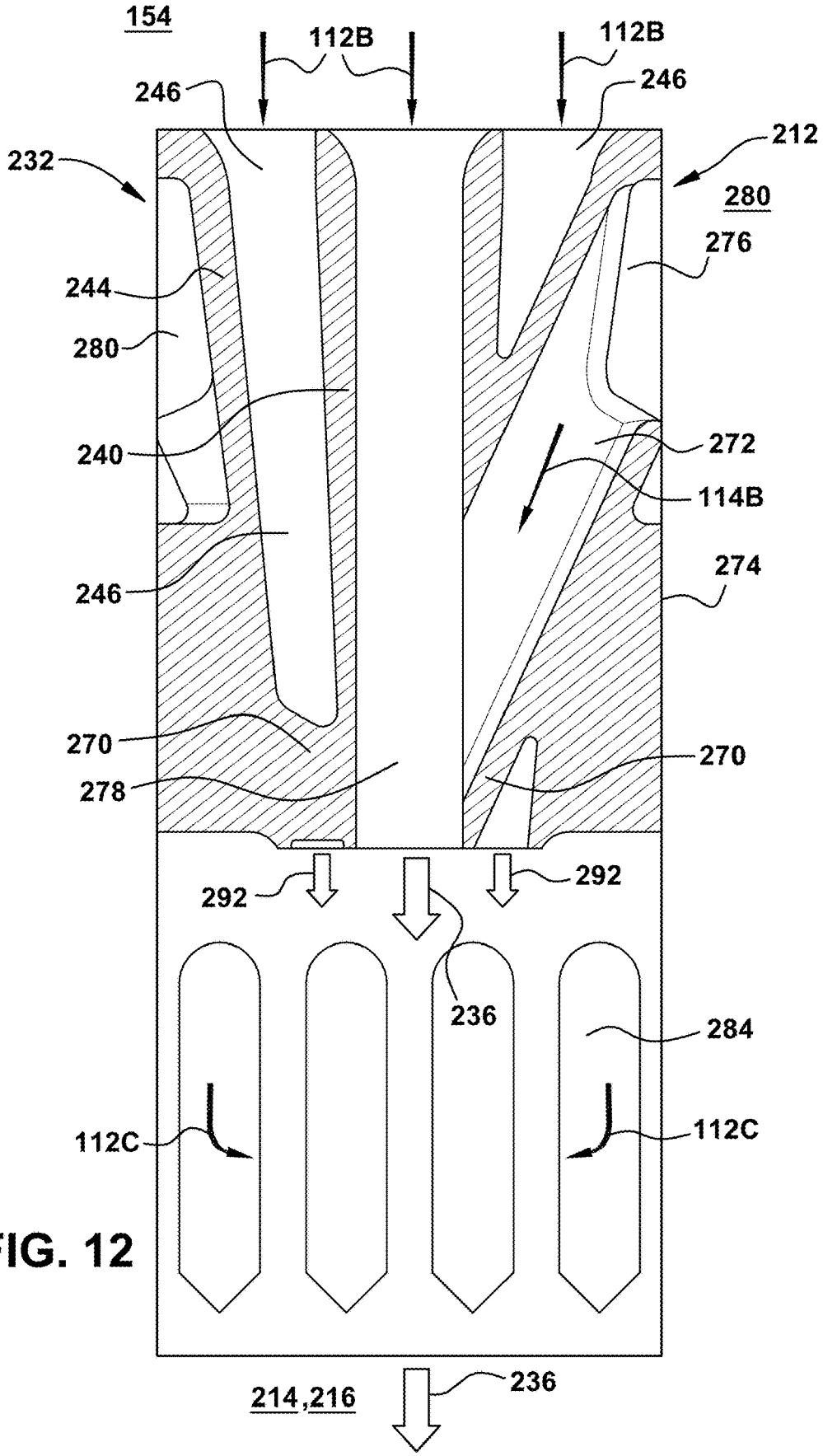
FIG. 12 shows a cross-sectional view along view line 12-12 in FIG. 9.

FIG. 7 shows a schematic cross-sectional perspective view, and FIG. 8 shows a schematic bottom-up view of an HP air-fuel injector 232 according to embodiments of the disclosure. It is noted that the schematic views of HP air-fuel injector 232 in FIGS. 7 and 8 are referred to as 'schematic' because the injectors typically are built with the rest of injection member 212, e.g., using additive manufacturing, and would not be separate entities as illustrated. In addition, FIG. 9 shows a perspective cross-sectional view of an HP air-fuel injector 232 within injection member 212, FIG. 10 shows a side view of HP air-fuel injector 232 in FIG. 9, FIG. 11 shows a cross-sectional view along view line 11-11 in FIG. 9 of HP air-fuel injector 232 and part of injection member 212, and FIG. 12 shows a cross-sectional view along view line 12-12 in FIG. 9 through a fuel injector according to embodiments of the disclosure.

Figure 9:
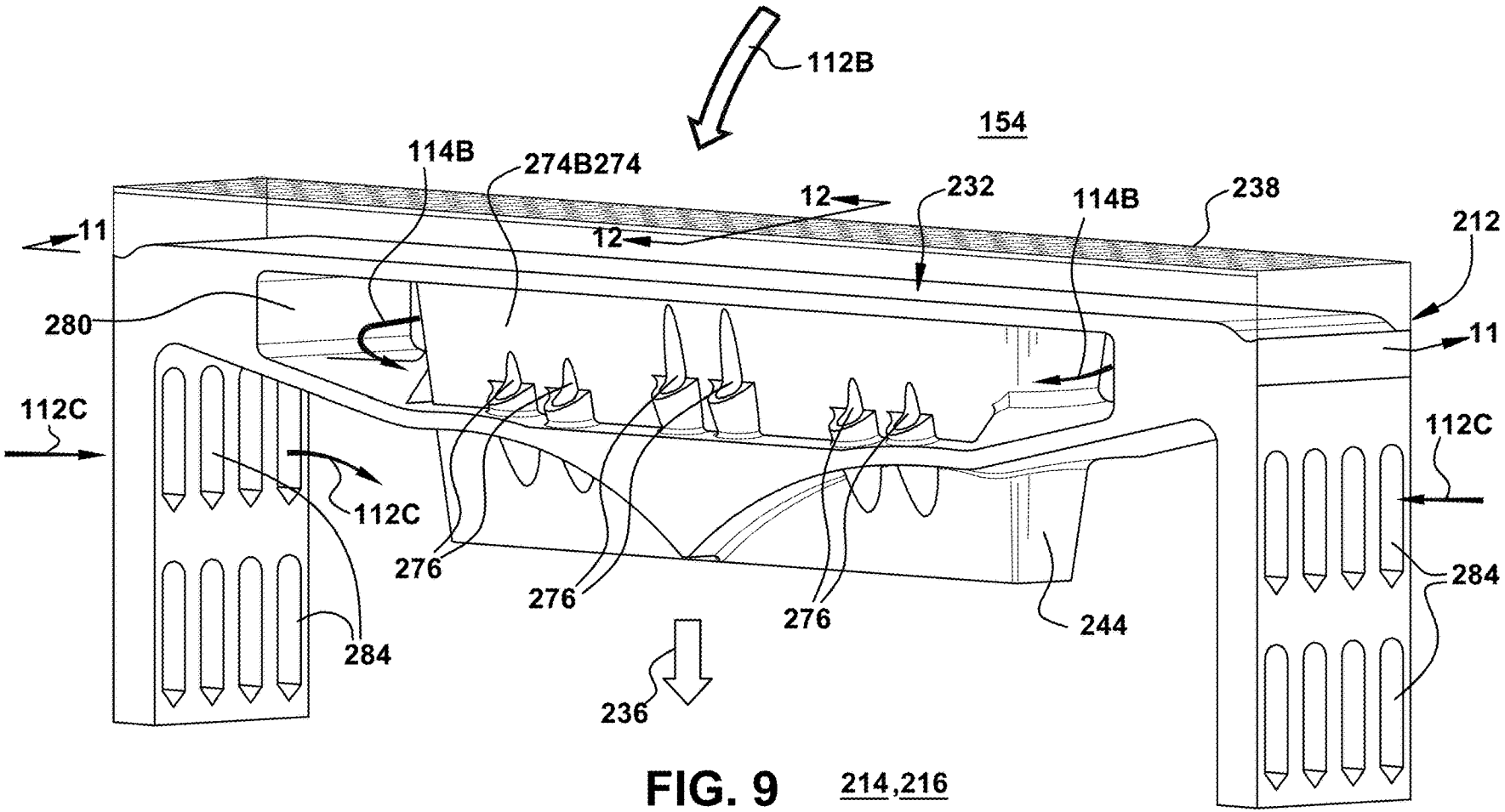
FIG. 9 shows a perspective and cross-sectional view of an HP air-fuel injector within an HP air-fuel injection member according to embodiments of the disclosure.

As shown in FIGS. 3 and 9 only for clarity, HP air-fuel injection member 212 may optionally include a filter member 238 upstream of (i.e., radially outward from) the set of HP air-fuel injectors 232. Filter member 238 may include any now known or later developed filter structure capable of preventing unwanted contaminants from entering AFS injector 150 from HP air source 154.

Figures 1, 13A:
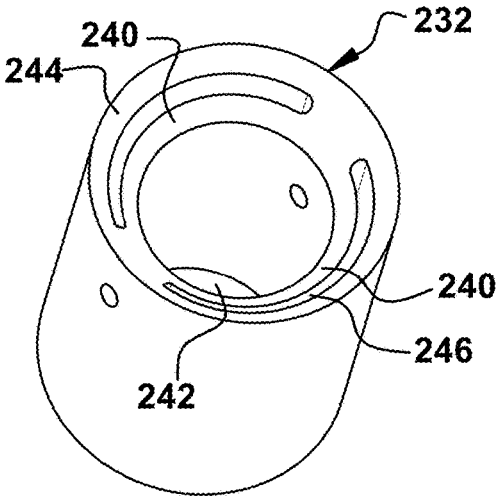
Figures 2, 13A:
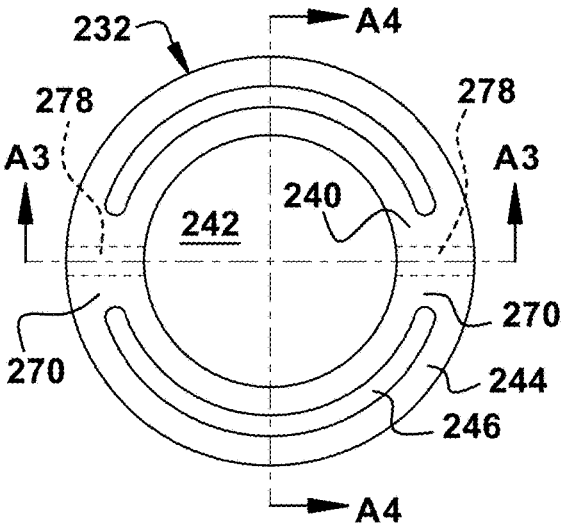
Figures 3, 13A:
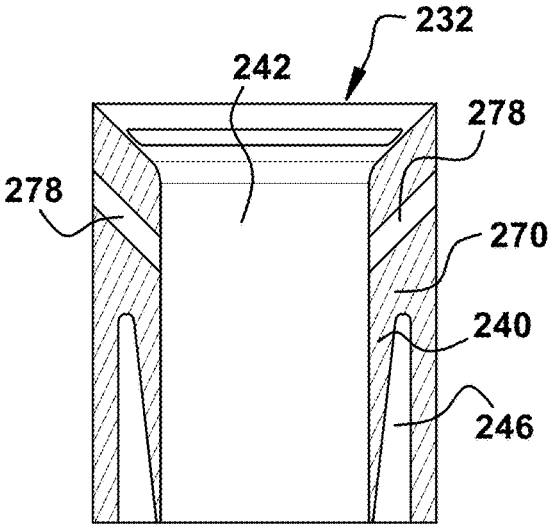
Figures 4, 13A:
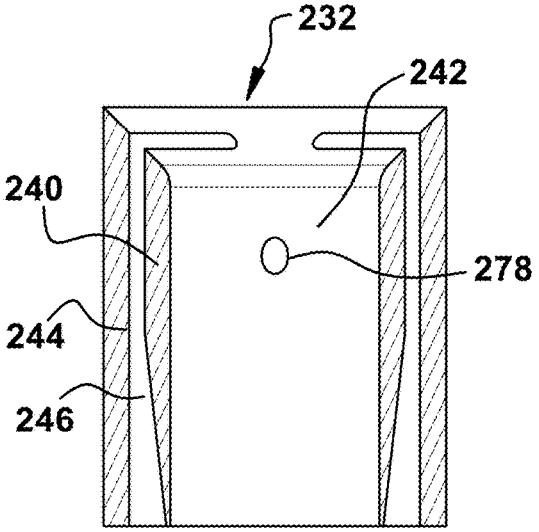
Figures 1, 13B:
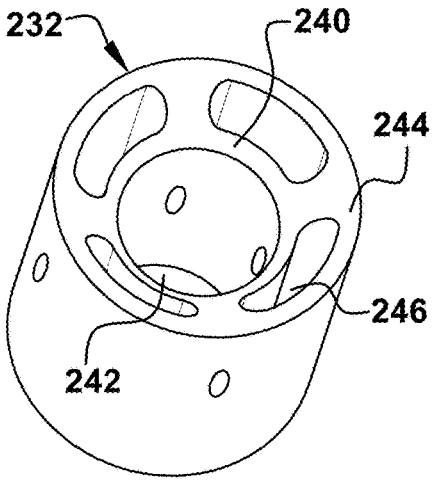
Figures 2, 13B:
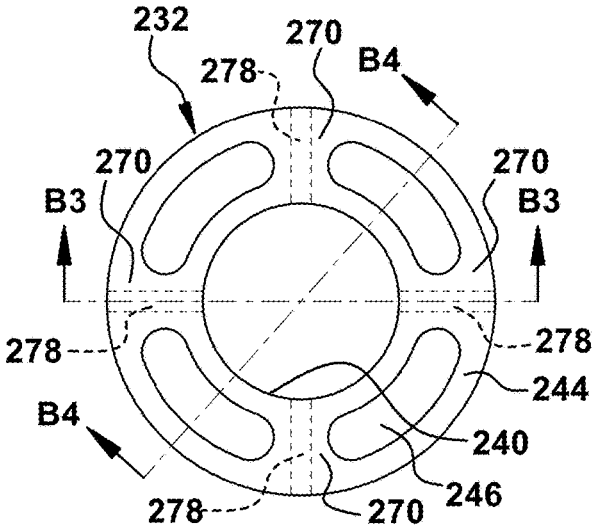
Figures 3, 13B:
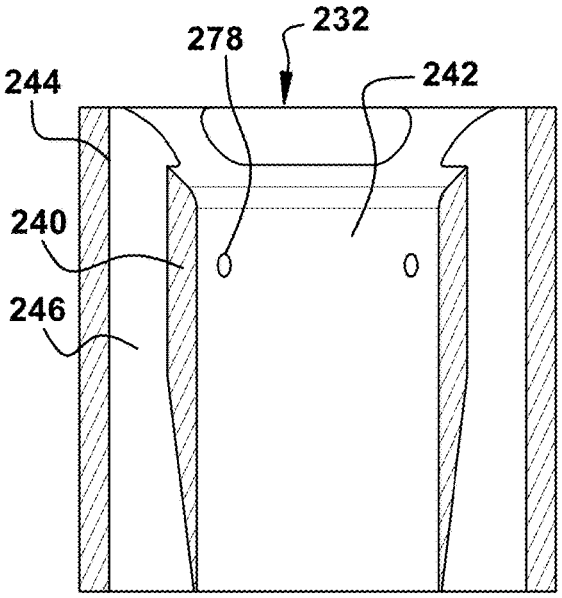
Figures 4, 13B:
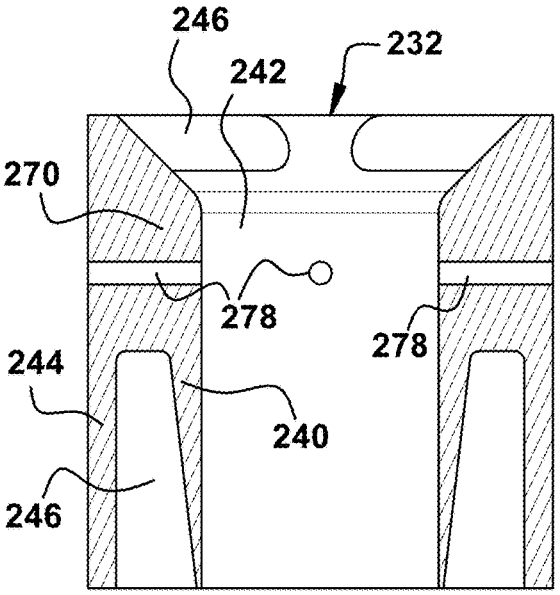
Figures 1, 13C:
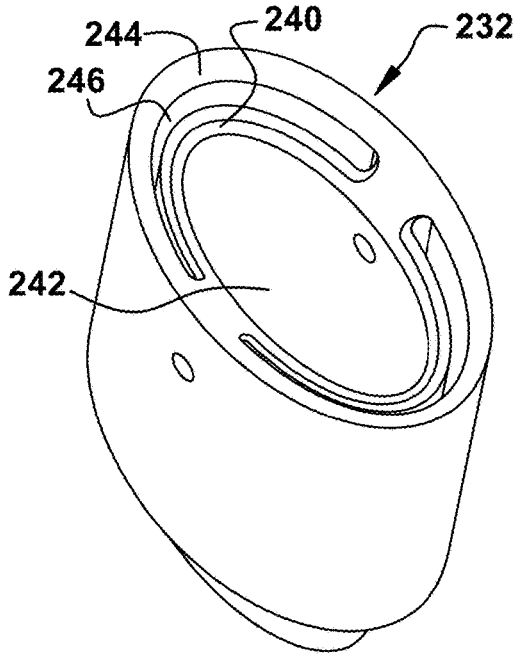
Figures 2, 13C:
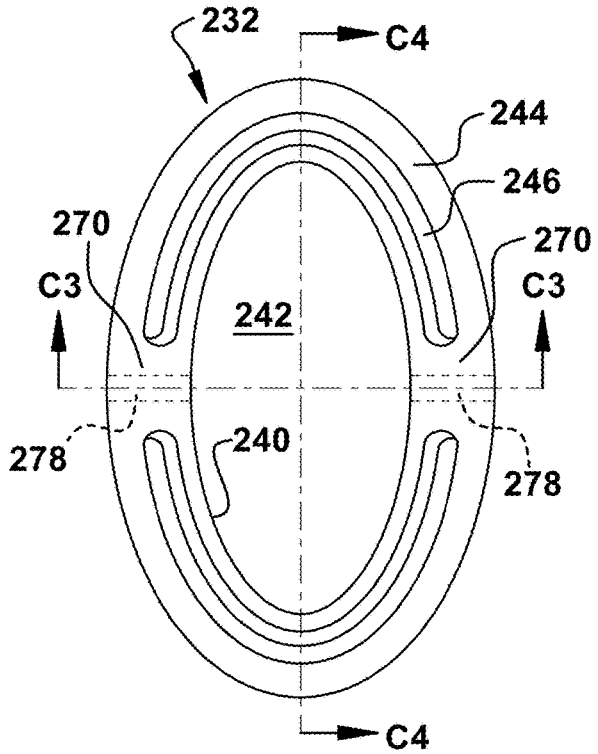
Figures 3, 13C:
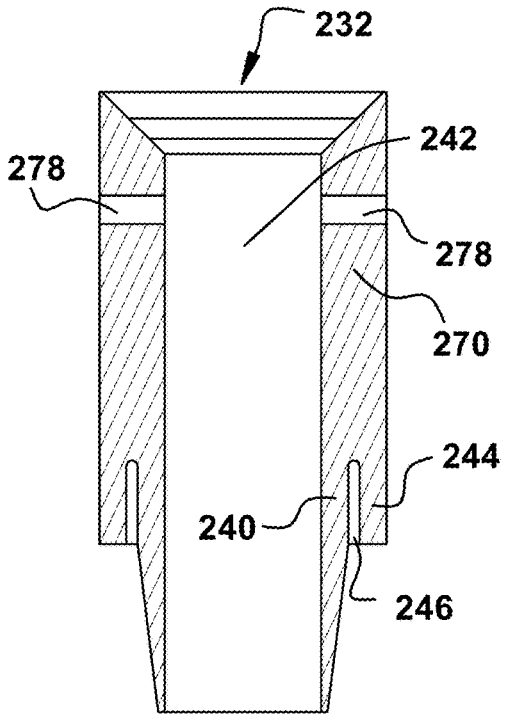
Figures 4, 13C:
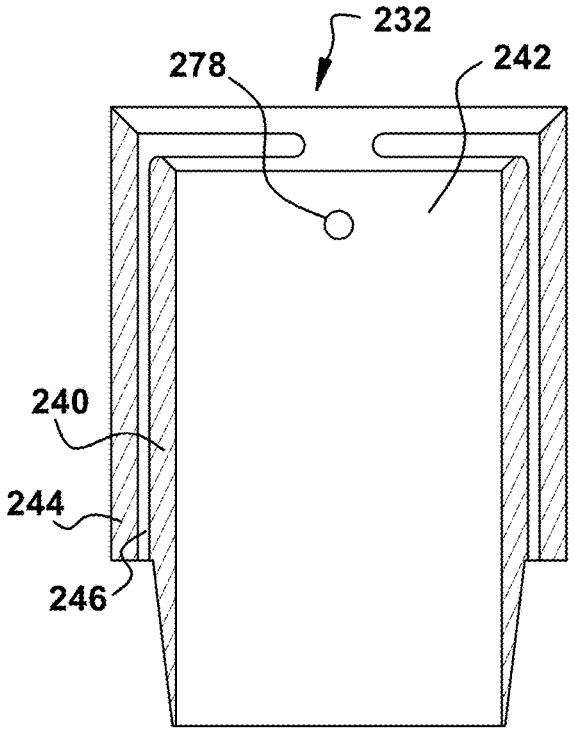
Figures 1, 13D:
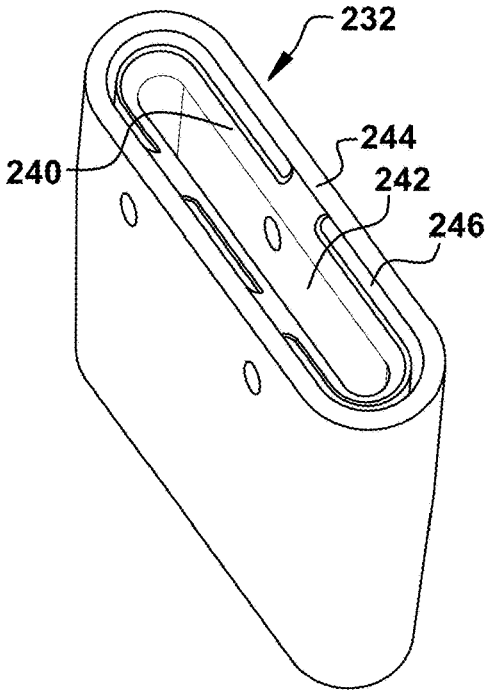
Figures 2, 13D:
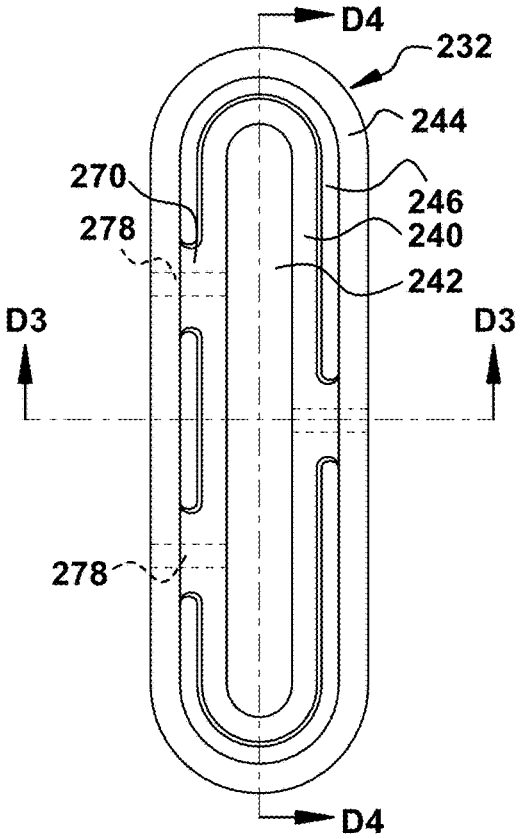
Figures 3, 13D:
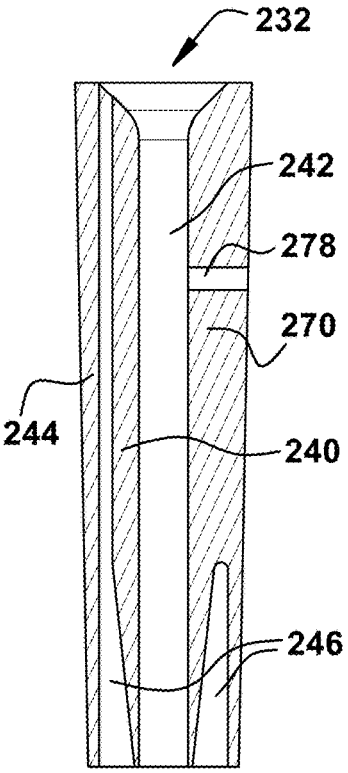
Figures 4, 13D:
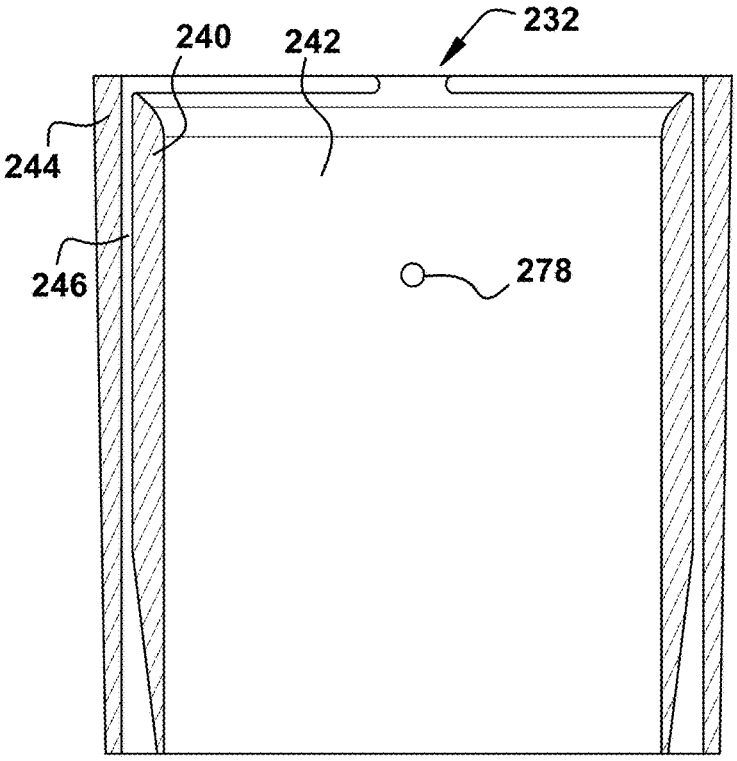

Referring to FIGS. 7 and 8, each HP air-fuel injector 232 includes an inner wall 240 defining an inner high-pressure (HP) air jet 242, and an outer wall 244 surrounding and concentric with inner wall 240. Inner wall 240 and outer wall 244 define an outer HP air jet loop 246 therebetween. That is, as shown in FIGS. 7 and 11, an outer surface 250 of inner wall 240 and an inner surface 252 of outer wall 244 define HP air jet loop 246 therebetween. Inner wall 240 may define inner HP air jet 242 with a variety of cross-sectional shapes. In one non-limiting example, each inner HP air jet 242 has an elongated cross-sectional shape, e.g., slot with rounded ends, elliptical or oval. In this example, inner HP air jets 242 are longer than they are wide and typically are relatively thin openings. However, inner HP air jets 242 can have other cross-sectional shapes. For example, FIGS. 13A1-4 show a circular cross-sectional shape for inner HP air jets 242 according to one embodiment; FIGS. 13B1-4 show a circular cross-sectional shape for inner HP air jets 242 according to another embodiment; FIGS. 13C1-4 show an oval or elliptical cross-sectional shape for inner HP air jets 242 according to other embodiments; and FIGS. 13D-14 show a racetrack (elongated elliptical) cross-sectional shape for inner HP air jets 242 according to another embodiment. FIGS. 13A1-4 show a version with two spacer members 270 and two fuel injectors 278, and FIGS. 13B1-4 show a version with four spacer members 270 and four fuel injectors 278.

Figure 14A:
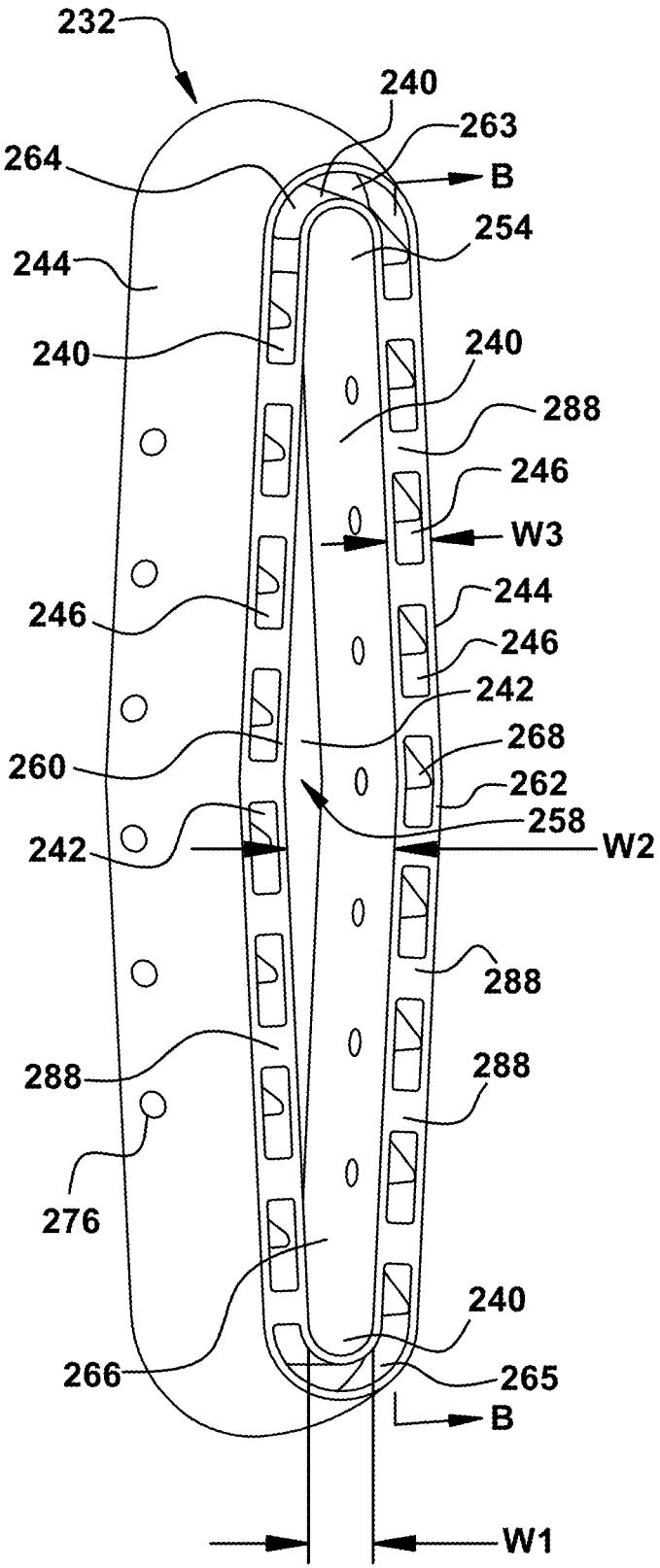
FIGS. 14A-B show schematic bottom-up views of an HP air-fuel injector according to various embodiments of the disclosure.
Figure 14B:
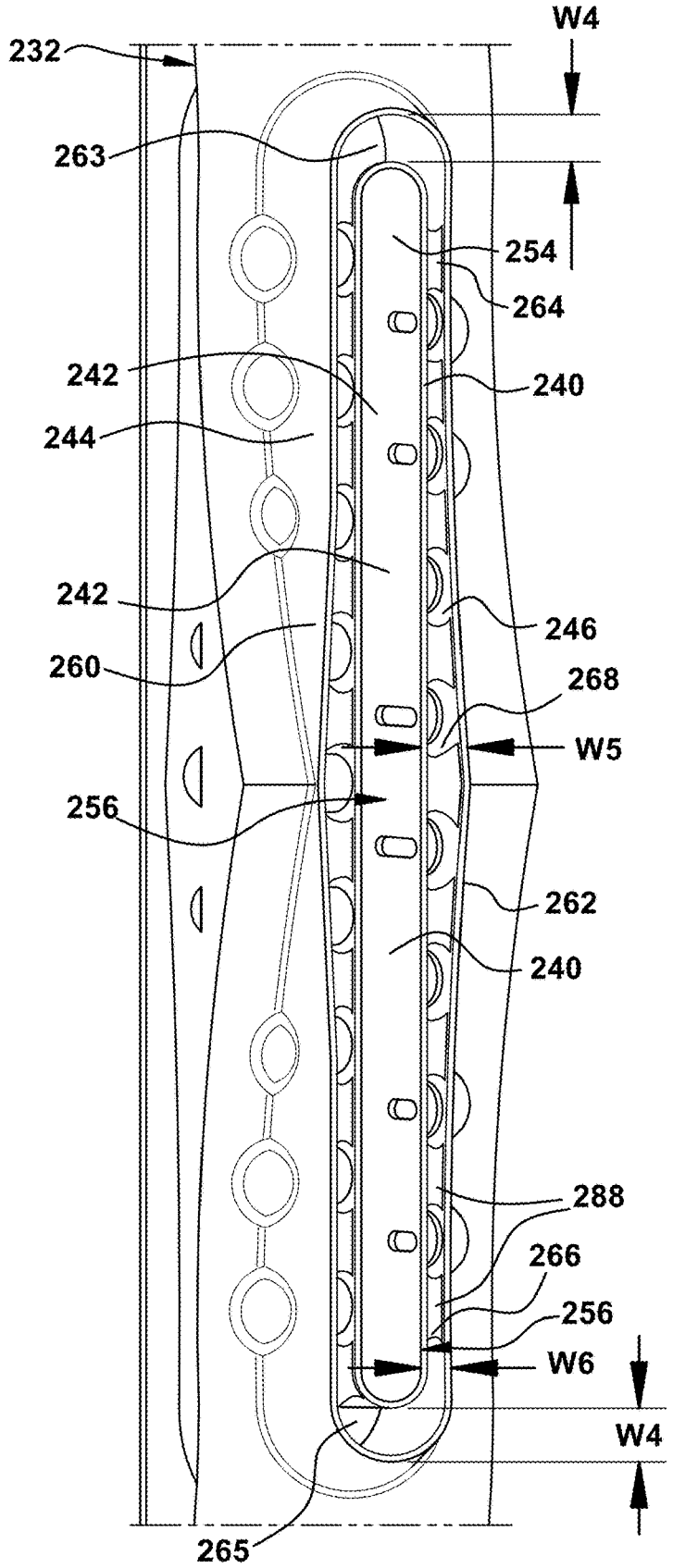

In another embodiment, as shown in FIG. 8, inner HP air jet 242 is elongated and includes a first end 254 and a second end 256 separated by a middle portion 258. FIGS. 14A and 14B show schematic bottom-up views of an HP air-fuel injector 232, similar to that in FIG. 8, according to various embodiments of the disclosure. As shown in FIGS. 8 and 14A, first end 254 and second end 256 may be narrower than middle portion 258, which allows more HP air 112B flow to middle portion 258 of inner HP air jet 242. That is, as shown in FIG. 14A, W2>W1. In this example, HP air jet loop 246 has a constant width W3.

HP air jet loop 246 can have any cross-sectional shape that surrounds inner wall 240 and is typically concentric therewith. In FIG. 7, HP air jet loop 246 has an oval or racetrack shape that mirrors the shape of outer surface 250 of inner wall 240. As shown in FIGS. 7 and 8, HP air jet loop 246 may also have opposing sides 260, 262. Each side 260, 262 may include opposing leading edge portions 263, 265 (so termed because they lead into air flow thereabout), a first longitudinal end portion 264 and a second longitudinal end portion 266 separated by a middle longitudinal portion 268. The portions labeled "longitudinal" portions are so referenced because they are in the elongated, straight portions of HP air jet loop 246 rather than the curved leading edge portions 263, 265. In certain embodiments, as shown in FIG. 14B, first leading edge portion 263 and second leading edge portion 265 may have a width W4 that is wider than a width (e.g., W5, W6) of other portions 264, 266, 268 of HP air jet loop 246, which allows more HP air 112B flow therefrom to promote mixing. That is, as shown in FIG. 14B, W4>W5>W6.

Similar to inner HP air jet 242, as shown in FIG. 8 and FIG. 14B, first longitudinal end portion 264 and second longitudinal end portion 266 may be narrower than middle longitudinal portion 268 on each of opposing sides 260, 262 of HP air jet loop 246, which allows more HP air 112B flow to middle portion 268. That is, as shown in FIG. 14B, W5>W6. Here, HP air jet loop 246 has opposing sides 260, 262 each with first longitudinal portion 264 and second longitudinal portion 266 separated by middle longitudinal portion 268, and first longitudinal portion 264 and second longitudinal portion 266 are narrower than middle longitudinal portion 268 on each of the opposing sides. The size of inner HP air jet 242 and HP air jet loop 246 can be user defined to generate the desired air-fuel mixture 236. Further, the axial spacing of inner HP air jets 242 (and HP air-fuel injectors 232), e.g., in a given row 230, and relative to axis A of combustion liner 164 can be user defined to generate the desired air-fuel mixture 236.

As shown in FIGS. 7 and 12, each HP air-fuel injector 232 may also include a spacer member 270 that spaces inner wall 240 from outer wall 244. Spacer member(s) 270 may define a width of HP air jet loop 246 and support inner wall 240 and outer wall 244 relative to one another.

With reference to FIGS. 7 and 9-12, HP air-fuel injector member 212 and, more particularly, HP air-fuel injectors 232, also include a plurality of fuel injector passages 272 extending from an outer surface 274 of outer wall 244, through spacer member 270 and inner wall 240 to inner HP air jet 242. Each fuel injector passage 272 has a first end 276 open at outer surface 274 of outer wall 244 and a second end 277 (FIGS. 7, 11) including a fuel injector 278 (FIGS. 7, 11) directed into inner HP air jet 242 defined by inner wall 240. Each fuel injector 278 is directed into inner HP air jet 242 so that HP air 112B traveling through inner HP air jet 242 pulls fuel 114B from fuel injector(s) 278 to create air-fuel mixture 236.

HP air-fuel injector member 212 also includes a fuel plenum 280 defined in HP air-fuel injection member 212 and in fluid communication with first end(s) 276 of each fuel injector passage 272. Hence, fuel plenum 280 is configured to deliver a fuel 114B from fuel source 116 (FIGS. 1-2) to each fuel injector 278. Fuel plenum 280 may extend within HP air-fuel injection member 212 in any manner necessary to supply fuel 114B to fuel injectors 278. More particularly, fuel plenum 280 may be defined to extend around adjacent HP air-fuel injectors 232. AFS injector 150, and more particularly, HP air-fuel injector member 212 may also include an inlet port 282 (FIG. 3) in fluid communication with fuel plenum 280 and configured to receive fuel 114B from fuel source 116 (FIGS. 1-2). Inlet port 282 of each AFS injector 150 may be fluidly coupled to fuel source 116 by, for example, fuel line(s) 188 (FIG. 2) and optionally a distribution plenum (not shown) about combustion liner 164. In any event, fuel plenum 280 is configured to deliver fuel 114B from fuel source 116 to fuel injector(s) 278. As noted, fuel 114B may be any now known or later developed combustor 100 fuel such as but not limited to fuel oil, natural gas, etc. Due to the advantages of AFS injector 150, fuel 114B may also include highly reactive fuels such as hydrogen. Fuel 114B may also include blends of fuels such as natural gas and hydrogen.

Fuel injector(s) 278 may have a variety of different shapes. In certain embodiments, as shown in FIGS. 7, 11 and 12, fuel injector(s) 278 directed into inner HP air jet 242 in inner wall 240 may each include an elongated slot, which may make them easier to print using additive manufacturing. In any event, fuel injectors 278 may introduce fuel 114B into inner HP air jet 242 in any desired direction. Further, the type, number, direction, spacing and size of fuel injectors 278 may be chosen depending on a wide variety of characteristics of, for example, combustor 100, HP air 112B, LP air 182 (if used), and/or fuel 114B. In terms of fuel 114B, for example, the characteristics may include but are not limited to: liquid or gas type, level of reactivity, viscosity, desired flow rate or volume, pressure, temperature, etc. Similar characteristics of air 112B and/or 182 may also be considered. In any event, other forms of fuel injectors 278 are also possible.

In certain embodiments, as shown in FIGS. 3 and 9-12, HP air-fuel injection member 212 may further include a plurality of HP air inlet openings 284 downstream of row(s) of HP air-fuel injectors 232 for directing another HP air flow 112C (from HP air source 154) into air-fuel mixture 236 and into inlet 216 of mixing chamber 214. Inlet openings 284 can have any desired number, cross-sectional shape or size, etc., to provide the desired HP air 112C flow into air-fuel mixture 236. In certain embodiments, inlet openings 284 can be elongated slots that are readily printable using additive manufacturing. Any number of rows of inlet openings 284 can be used. FIGS. 9-11 show two rows, and FIGS. 3 and 12 show only one row of inlet openings 284. FIG. 4 shows HP air-fuel injection member 212 without inlet openings.

As noted, FIG. 15 shows a perspective and partial cross-sectional view of AFS injector 150 according to an alternative embodiment. In this embodiment, mixing member 210 and/or HP air-fuel injection member 212 are configured to have an opening 286 such that LP air 182 from LP air source 184, as described herein, can be drawn into air-fuel mixture 236. More particularly, HP air 112B as part of air-fuel mixture 236 draws LP air 182 from LP air source 184 to direct LP air 182 with HP air 112B and fuel 114B into inlet 216 of mixing chamber 214. Although not necessary, FIG. 15 also shows an option in which HP air-fuel injection member 212 further includes plurality of HP air inlet openings 284 downstream of row(s) of HP air-fuel injectors 232 for directing another HP air flow 112C into air-fuel mixture 236 and into inlet 216 of mixing chamber 214. Here, HP air flow 112B also draws LP air 182 from LP air source 184 to direct LP air 182 with HP air 112B and fuel 114B into inlet 216 of mixing chamber 214. It is noted, however, that HP air inlet openings 284 and LP air 182 do not need to be used together.

Figure 16:
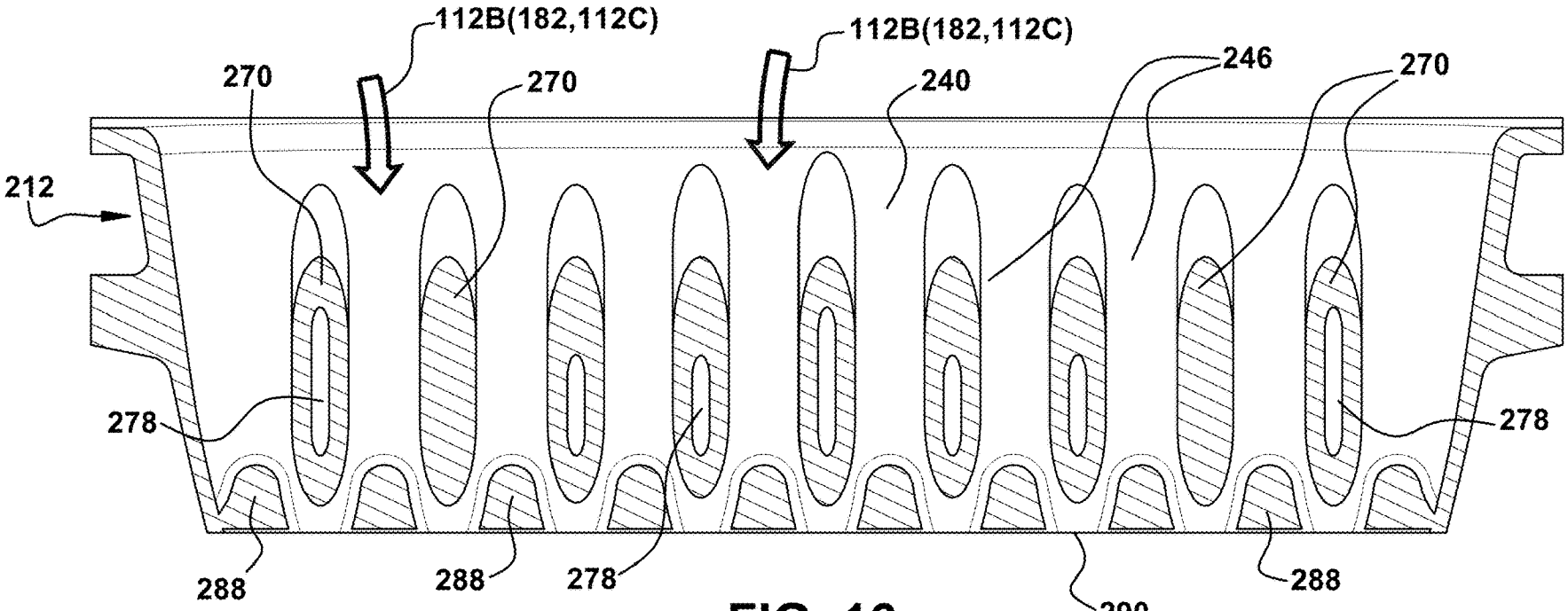
FIG. 16 shows a cross-sectional view along view line B-B in FIG. 8.

FIG. 16 shows a cross-sectional view along view line B-B in FIG. 8. Referring to FIGS. 8 and 16, AFS injector 150 may also include a plurality of diversion members 288 between inner wall 240 and outer wall 244 adjacent an outlet 290 of HP air jet loop 246. Diversion members 288 may shape HP air flow 112B in HP air jet loop 246 that forms an HP air curtain 292 (FIG. 7) adjacent outlet 290 of inner HP air jet 242 from which air-fuel mixture 236 exits. In any event, diversion members 288 act to direct and shape HP air curtain 292 around air-fuel mixture 236 exiting inner HP air jet 242, i.e., downstream of fuel injectors 278, to minimize low velocity regions where fuel can be entrained and result in flame holding. Diversion members 288 also promote mixing of HP air 112B and LP air 182 to lower NOx emissions. Diversion member 288 can take any shape to generate the desired air flow shape of air curtain 292.

As noted previously, FIG. 15 shows embodiments of AFS injector 150 that use LP air 182. However, use of LP air 182 is optional and can be omitted by not providing fluid communication of AFS injector 150 with LP air source 184. In this latter setting, as shown in FIG. 3, mixing member 210 and/or injection member 212 may include a wall 294 that prevents any LP air 182 from entering mixing chamber 214.

With regard to operations, as shown in FIGS. 3, 4, 7 and 12, HP air 112B enters each inner HP air jet 242, perhaps through filter 238 when provided. Fuel 114B is delivered from fuel plenum 280 via fuel injector passages 272 to each fuel injector 278. HP air 112B flow in inner HP air jet 242 draws in fuel 114B (fuel 114B also possibly under pressure from fuel source 116 (FIGS. 1-2)), creating air-fuel mixture 236. Where LP air 182 is provided, as shown in FIG. 15, LP air 182 is also drawn into air-fuel mixture 236. Where HP air inlet openings 284 are provided downstream of row(s) 230 of HP air-fuel injectors 232, they may also direct another HP air flow 112C into air-fuel mixture 236. HP air jet loop 246 forms HP air curtain 292 to minimize the trailing edge wake after fuel injectors 278, and places HP air 112B on both sides of a trailing edge of inner HP air jet 242, i.e., of inner wall 240. The configuration results in better mixing because of the shear of HP air 112B with fuel 114B and any other air flow provided, e.g., LP air 182 and/or HP air 112C from HP air inlet openings 284. In one non-limiting example, the configuration results in 90% mixing of fuel and air.

In any event, air-fuel mixture 236 is directed into inlet 216 of mixing chamber 214, and eventually combustion liner 164 as an air-fuel mixture 296 for combustion in secondary combustion zone 204. Hence, air-fuel mixture 236 entering mixing chamber 214 (and the air-fuel mixture 296 exiting mixing chamber 214) may include HP air 112B and fuel 114B and may include LP air 182 and additional HP air 112C, where the latter two air flows are provided. It is noted that air-fuel mixtures 236, 296 may be referenced as high-pressure despite the mixing with LP air 182 because it/they retains a relatively high pressure, although not as high as HP air 112B, 112C taken directly from HP air source 154, e.g., compressor discharge 109 (FIG. 2). Each HP air-fuel injector 232 is configured to direct air-fuel mixture 236 toward inlet 216 of mixing chamber 214. Within mixing chamber 214, additional mixing of air 112B, 112C and/or 182 and fuel 114B occurs prior to air-fuel mixture 296 exiting AFS injector 150 into combustion liner 164 where it is combusted in secondary combustion zone 204. Low velocity regions and/or fuel rich concentration areas that can hold flame are omitted. HP air-fuel injectors 232 mix fuel 114B and HP air 112B without generating any of the aforementioned issues.

AFS injector 150, i.e., mixing member 210 and injection member 212, may be made of any now known or later developed combustion tolerant and oxidation resistant materials. The material may be metal and can be a pure metal or an alloy. AFS injectors 150 may include a metal that is typically used in turbine components such as turbine blades or nozzles and that has a higher temperature and higher oxidation tolerance than materials typically used for combustion hardware. In this case, the material may include a non-reactive metal, e.g., made from a non-explosive or non-conductive powder, such as but not limited to: a cobalt chromium molybdenum (CoCrMo) alloy, stainless steel, an austenite nickel-chromium based alloy such as a nickel-chromium-molybdenum-niobium alloy (NiCrMoNb) (e.g., Inconel 625 or Inconel 718), a nickel-chromium-iron-molybdenum alloy (NiCrFeMo) (e.g., Hastelloy® X available from Haynes International, Inc.), a nickel-chromium-cobalt-molybdenum alloy (NiCrCoMo) (e.g., Haynes 233 or Haynes 282 available from Haynes International, Inc.), or a nickel-chromium-cobalt-titanium alloy (NiCrCoTi) (e.g., GTD 262 developed by General Electric Company). Other possibilities include, for example, René 108, CM 247, Mar M 247, and any precipitation harden-able (PH) nickel alloy.

Figure 17:
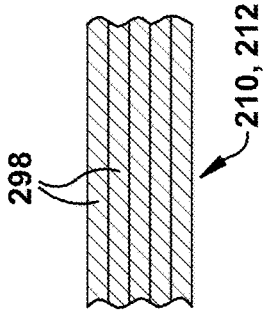
FIG. 17 shows a cross-sectional view of a plurality of parallel, sintered metal layers of a mixing member or a high-pressure air injection member of an AFS injector according to embodiments of the disclosure.
Figure 18:
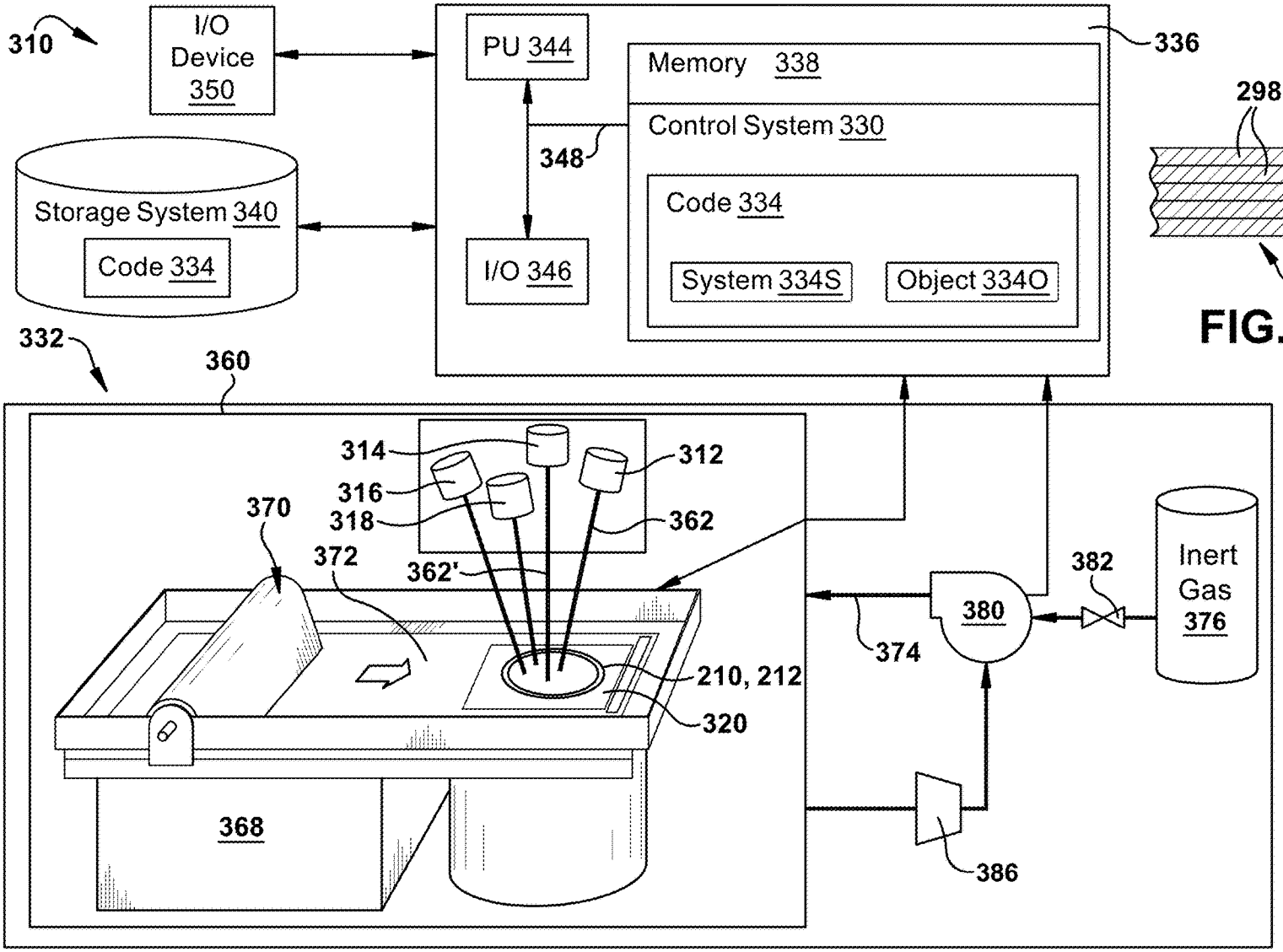
FIG. 18 shows a schematic block diagram of an illustrative additive manufacturing system for additively manufacturing a mixing member and/or a HP air-fuel injection member of an AFS injector according to embodiments of the disclosure.

In certain embodiments, AFS injectors 150, i.e., mixing member 210 and/or injection member 212, may be additively manufactured using any now known or later developed technique capable of forming an integral body. Consequently, as shown in FIG. 17, mixing member 210 and/or injection member 212 includes a plurality of parallel, sintered metal layers 298. FIG. 18 shows a schematic/block view of an illustrative computerized metal powder additive manufacturing system 310 (hereinafter 'AM system 310') for generating AFS injector 150, i.e., mixing member 210 and/or injection member 212, of which only a single layer is shown. The teachings of the disclosures will be described relative to building mixing member 210 and/or injection member 212 using multiple melting beam sources 312, 314, 316, 318, but it is emphasized and will be readily recognized that the teachings of the disclosure are equally applicable to build mixing member 210 and/or injection member 212 using any number of melting beam sources. In this example, AM system 310 is arranged for direct metal laser melting (DMLM). It is understood that the general teachings of the disclosure are equally applicable to other forms of metal powder additive manufacturing such as but not limited to selective laser melting (SLM), and perhaps other forms of additive manufacturing (i.e., other than metal powder applications). The layer of mixing member 210 and/or injection member 212 in build platform 320 is illustrated as a circular element in FIG. 18; however, it is understood that the additive manufacturing process can be readily adapted to manufacture any shape on build platform 320.

AM system 310 generally includes an additive manufacturing control system 330 ("control system") and an AM printer 332. As will be described, control system 330 executes set of computer-executable instructions or code 334 to generate mixing member 210 and/or injection member 212 using multiple melting beam sources 312, 314, 316, 318. In the example shown, four melting beam sources may include four lasers. However, the teachings of the disclosures are applicable to any melting beam source, e.g., an electron beam, laser, etc. Control system 330 is shown implemented on computer 336 as computer program code. To this extent, computer 336 is shown including a memory 338 and/or storage system 340, a processor unit (PU) 344, an input/output (I/O) interface 346, and a bus 348. Further, computer 336 is shown in communication with an external I/O device/resource 350.

In general, processor unit (PU) 344 executes computer program code 334 that is stored in memory 338 and/or storage system 340. While executing computer program code 334, processor unit (PU) 344 can read and/or write data to/from memory 338, storage system 340, I/O device 350 and/or AM printer 332. Bus 348 provides a communication link between each of the components in computer 336, and I/O device 350 can comprise any device that enables a user to interact with computer 336 (e.g., keyboard, pointing device, display, etc.). Computer 336 is only representative of various possible combinations of hardware and software. For example, processor unit (PU) 344 may comprise a single processing unit or be distributed across one or more processing units in one or more locations, e.g., on a client and server. Similarly, memory 338 and/or storage system 340 may reside at one or more physical locations. Memory 338 and/or storage system 340 can comprise any combination of various types of non-transitory computer readable storage medium including magnetic media, optical media, random access memory (RAM), read only memory (ROM), etc. Computer 336 can comprise any type of computing device such as an industrial controller, a network server, a desktop computer, a laptop, a handheld device, etc.

As noted, AM system 310 and, in particular control system 330, executes code 334 to generate mixing member 210 and/or injection member 212. Code 334 can include, among other things, a set of computer-executable instructions 334S (herein also referred to as 'code 334S') for operating AM printer 332, and a set of computer-executable instructions 334O (herein also referred to as 'code 334O') defining mixing member 210 and/or injection member 212 to be physically generated by AM printer 332. As described herein, additive manufacturing processes begin with a non-transitory computer readable storage medium (e.g., memory 338, storage system 340, etc.) storing code 334. Set of computer-executable instructions 334S for operating AM printer 332 may include any now known or later developed software code capable of operating AM printer 332.

The set of computer-executable instructions 334O defining mixing member 210 and/or injection member 212 may include a precisely defined 3D model of mixing member 210 and/or injection member 212 and can be generated from any of a large variety of well-known computer aided design (CAD) software systems such as AutoCAD®, TurboCAD®, DesignCAD 3D Max, etc. In this regard, code 334O can include any now known or later developed file format. Furthermore, code 334O representative of mixing member 210 and/or injection member 212 may be translated between different formats. For example, code 334O may include Standard Tessellation Language (STL) files which were created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 334O representative of mixing member 210 and/or injection member 212 may also be converted into a set of data signals and transmitted, received as a set of data signals and converted to code, stored, etc., as necessary. Code 334O may be configured according to embodiments of the disclosure to allow for formation of border and internal sections in overlapping field regions, as will be described. In any event, code 334O may be an input to AM system 310 and may come from a part designer, an intellectual property (IP) provider, a design company, the operator or owner of AM system 310, or from other sources. In any event, control system 330 executes code 334S and 334O, dividing mixing member 210 and/or injection member 212 into a series of thin slices that assembles using AM printer 332 in successive layers of material.

AM printer 332 may include a processing chamber 360 that is sealed to provide a controlled atmosphere for mixing member 210 and/or injection member 212 printing. A build platform 320, upon which mixing member 210 and/or injection member 212 is/are built, is positioned within processing chamber 360. A number of melting beam sources 312, 314, 316, 318 are configured to melt layers of metal powder on build platform 320 to generate mixing member 210 and/or injection member 212. While four melting beam sources 312, 314, 316, 318 are illustrated, it is emphasized that the teachings of the disclosure are applicable to a system employing any number of sources, e.g., 1, 2, 3, or 5 or more. As understood in the field, each melting beam source 312, 314, 316, 318 may have a field including a non-overlapping field region, respectively, in which it can exclusively melt metal powder, and may include at least one overlapping field region in which two or more sources can melt metal powder. In this regard, each melting beam source 312, 314, 316, 318 may generate a melting beam, respectively, that fuses particles for each slice, as defined by code 334O. For example, in FIG. 18, melting beam source 312 is shown creating a layer of mixing member 210 and/or injection member 212 using melting beam 362 in one region, while melting beam source 314 is shown creating a layer of mixing member 210 and/or injection member 212 using melting beam 362' in another region.

Each melting beam source 312, 314, 316, 318 is calibrated in any now known or later developed manner. That is, each melting beam source 312, 314, 316, 318 has had its laser or electron beam's anticipated position relative to build platform 320 correlated with its actual position in order to provide an individual position correction (not shown) to ensure its individual accuracy. In one embodiment, each of plurality melting beam sources 312, 314, 316, 318 may create melting beams, e.g., 362, 362', having the same cross-sectional dimensions (e.g., shape and size in operation), power and scan speed.

Continuing with FIG. 18, an applicator (or re-coater blade) 370 may create a thin layer of raw material 372 spread out as the blank canvas from which each successive slice of the final mixing member 210 and/or injection member 212 will be created. Various parts of AM printer 332 may move to accommodate the addition of each new layer, e.g., a build platform 320 may lower and/or chamber 360 and/or applicator 370 may rise after each layer. The process may use different raw materials in the form of fine-grain metal powder, a stock of which may be held in a powder reservoir 368 accessible by applicator 370.

Processing chamber 360 is filled with an inert gas such as argon or nitrogen and controlled to minimize or eliminate oxygen. Control system 330 is configured to control a flow of a gas mixture 374 within processing chamber 360 from a source of inert gas 376. In this case, control system 330 may control a pump 380, and/or a flow valve system 382 for inert gas to control the content of gas mixture 374. Flow valve system 382 may include one or more computer controllable valves, flow sensors, temperature sensors, pressure sensors, etc., capable of precisely controlling flow of the particular gas. Pump 380 may be provided with or without valve system 382. Where pump 380 is omitted, inert gas may simply enter a conduit or manifold prior to introduction to processing chamber 360. Source of inert gas 376 may take the form of any conventional source for the material contained therein, e.g., a tank, reservoir or other source. Any sensors (not shown) required to measure gas mixture 374 may be provided. Gas mixture 374 may be filtered using a filter 386 in a conventional manner.

In operation, build platform 320 with metal powder thereon is provided within processing chamber 360, and control system 330 controls flow of gas mixture 374 within processing chamber 360 from source of inert gas 376. Control system 330 also controls AM printer 332, and in particular, applicator 370 and melting beam sources 312, 314, 316, 318 to sequentially melt layers of metal powder on build platform 320 to generate mixing member 210 and/or injection member 212 according to embodiments of the disclosure. While a particular AM system 310 has been described herein, it is emphasized that the teachings of the disclosure are not limited to any particular additive manufacturing system or method.

Once mixing member 210 and injection member 212 are formed, they may be assembled to form AFS injector 150 with other parts of combustor 100, as shown in FIG. 2. For example, as shown in FIG. 3, mixing member 210 and/or injection member 212 may be bolted to AFS injector mounts 275 (FIGS. 3 and 15) therefor on combustion liner 164. More particularly, as noted, mixing member 210 and HP air-fuel injection member 212 may each include at least one mounting element 213 configured to receive fastener 215, e.g., bolt or weld, to couple mixing member 210 and HP air-fuel injection member 212 to combustion liner 164 that defines combustion chamber 172, i.e., to AFS injector mounts 275 of combustion liner 164.

Embodiments of the disclosure may also include combustor 100 for GT system 90. Combustor 100 includes combustor body 160 including combustion liner 164. Combustor 100 may also include a plurality of AFS injectors 150, as described herein, directed into combustion liner 164. Returning to FIG. 2, combustor 100 generally terminates at a point that is adjacent to a first stage 295 of stationary nozzles 297 of turbine 128. First stage 295 of stationary nozzles 297 at least partially defines turbine inlet 142 to turbine 128. Combustor body 160, i.e., combustion liner 164, at least partially defines a hot gas path (HGP) for routing combustion gases 122 from primary combustion zone 202 and secondary combustion zone 204 to turbine inlet 142 of turbine 128 during operation of GT system 90. Due to the small size of AFS injectors 150 (namely, the radial height RH between a radially outermost surface of injection member 212 and an inner surface of combustion liner 164, as shown in FIG. 4), they can be assembled onto combustion liner 164 of combustor body 160 (FIG. 2), and combustor body 160 with mounted AFS injectors 150 can be installed in a generally axial direction into GT system 90 through the relatively small opening (not shown) in a compressor discharge casing (in casing 152).

Embodiments of the disclosure may also include, as shown in FIG. 1, GT system 90 including compressor section 110, combustion section 120 operatively coupled to compressor section 110, and turbine section 130 operatively coupled to combustion section 120. As described herein, combustion section 120 includes at least one combustor 100 including combustor body 160 including combustion liner 164, and head end fuel nozzle assembly 176 at a forward end of combustor body 160. Combustor 100 may also include a plurality of AFS injectors 150, as described herein, directed into combustor body 160, i.e., into combustion liner 164, downstream of head end assembly 176.

The disclosure provides various technical and commercial advantages, examples of which are discussed herein. As described herein, the AFS injector can accept high-pressure air and optionally low-pressure air, e.g., post-impingement cooling air, to reduce overall system pressure loss. The HP air jet loop creates an air curtain to focus the HP, high velocity air in the wake behind where the fuel injectors to prevent flame attachment to the hardware. The inner HP jet and the HP air jet loop, among other things, can be tailored to produce the desired velocity profile. The AFS injector may optionally mix up to three sources of air, two being high-pressure air, e.g., from a compressor discharge, and the other a low-pressure air, e.g., post-impingement cooling air, to reduce overall system pressure loss and more efficiently use air in the combustor. In any event, the AFS injector can rapidly premix the air source(s) with, for example, highly reactive fuels, like hydrogen, to achieve low emissions, e.g., of nitrous oxide (NOx), and an acceptable flame holding capability. The AFS injector also achieves high mixedness of fuel and air, minimizes flow-pressure loss, and prevents fuel from entering any low velocity air flow zones. Additionally, the AFS injector is packaged in a relatively small geometry, allowing it to be assembled onto the combustion liner of a combustor body, and the combustor body installed axially into the GT system through the relatively small opening in a compressor discharge casing. The AFS injector may be additively manufactured to include a plurality of parallel, sintered metal layers.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" or "about," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and its practical application and to enable others of ordinary skill in the art to understand the disclosure for envisioning embodiments with various modifications as are suited to the particular use contemplated.

What is claimed is:

1. An axial fuel stage (AFS) injector for a combustor of a gas turbine (GT) system, the AFS injector comprising:

a mixing member including a mixing chamber defined therein, the mixing chamber having an inlet and an outlet, wherein the outlet is configured to be in fluid communication with a combustion chamber of the combustor;

a high pressure (HP) air-fuel injection member including at least one row of HP air-fuel injectors for directing an air-fuel mixture into the mixing chamber, each HP air-fuel injector including:

an inner wall defining an inner HP air jet conduit therein;

an outer wall surrounding and concentric with the inner wall, wherein the inner wall and the outer wall define an outer HP air jet loop therebetween;

a plurality of spacer members spacing the inner wall from the outer wall; and a plurality of fuel injector passages extending from an outer surface of the outer wall, through the plurality of spacer members and the inner wall to the inner HP air jet conduit, each fuel injector passage having a first end open at the outer surface of the outer wall and a second end including a fuel injector directed into the inner HP air jet conduit defined by the inner wall; and a fuel plenum defined in the HP air-fuel injection member and in fluid communication with the first end of each fuel injector passage, the fuel plenum configured to deliver a fuel from a fuel source to each of the fuel injectors, wherein each inner HP air jet conduit and each HP air jet loop are configured to direct a HP air flow from a HP air source with the fuel into the inlet of the mixing chamber.

2. The AFS injector of claim 1, wherein the HP air-fuel injection member further includes a plurality of HP air inlet openings downstream of the at least one row of HP air-fuel injectors for directing another HP air flow into the air-fuel mixture and into the inlet of the mixing chamber.

3. The AFS injector of claim 1, wherein the HP air flow also draws a low pressure (LP) air from a LP air source to direct the LP air with the HP air and the fuel into the inlet of the mixing chamber.

4. The AFS injector of claim 1, wherein the HP air-fuel injection member further includes a plurality of HP air inlet openings downstream of the at least one row of HP air-fuel injectors for directing another HP air flow into the air-fuel mixture and into the inlet of the mixing chamber, and wherein the HP air flow also draws a low pressure (LP) air from a LP air source to direct the LP air with the HP air and the fuel into the inlet of the mixing chamber.

5. The AFS injector of claim 1, wherein the fuel injector directed into the inner HP air jet conduit in the inner wall of each fuel injector passage includes an elongated slot.

6. The AFS injector of claim 5, wherein the HP air jet loop has opposing sides each with a first longitudinal end portion and a second longitudinal end portion separated by a middle longitudinal portion, and wherein each of the first longitudinal end portion and the second longitudinal end portion is narrower than the middle longitudinal portion on each of the opposing sides.

7. The AFS injector of claim 1, wherein the inner HP air jet conduit is elongated and includes a first end and a second end separated by a middle portion, and wherein each of the first end and the second end is narrower than the middle portion.

8. The AFS injector of claim 1, wherein the at least one row of HP air-fuel injectors includes a first row of HP air-fuel injectors and a second row of HP air-fuel injectors.

9. The AFS injector of claim 1, wherein the at least one row of HP air-fuel injectors includes a first row of HP air-fuel injectors, a second row of HP air-fuel injectors and a third row of HP air-fuel injectors between the first row and second row of HP air-fuel injectors.

10. The AFS injector of claim 9, wherein the HP air-fuel injectors of the third row of HP air-fuel injectors direct the air-fuel mixture in a direction parallel to the mixing chamber, and the first row and the second row of HP air-fuel injectors direct the air-fuel mixture at an acute angle to the direction parallel to the mixing chamber.

11. The AFS injector of claim 1, further comprising a plurality of diversion members between the inner wall and the outer wall adjacent an outlet of the HP air jet loop.

12. The AFS injector of claim 1, wherein the mixing member includes a filter member upstream of the at least one row of HP air-fuel injectors.

13. The AFS injector of claim 1, wherein the mixing member and the HP air-fuel injection member each include at least one mounting element configured to receive a fastener to couple the mixing member and the HP air-fuel injection member to a combustion liner that defines the combustion chamber.

14. The AFS injector of claim 1, wherein the HP air source is in direct fluid communication with a compressor discharge of the GT system.

15. A combustor for a gas turbine system, the combustor comprising:

a combustor body including a combustion liner; and a plurality of axial fuel stage (AFS) injectors directed into the combustion liner, at least one AFS injector including:

a mixing member including a mixing chamber defined therein, the mixing chamber having an inlet and an outlet, wherein the outlet is configured to be in fluid communication with a combustion chamber of the combustor;

a high pressure (HP) air-fuel injection member including at least one row of HP air-fuel injectors for directing an air-fuel mixture into the mixing chamber, each HP air-fuel injector including:

an inner wall defining an inner HP air jet conduit therein;

an outer wall surrounding and concentric with the inner wall, wherein the inner wall and the outer wall define an outer HP air jet loop therebetween;

a plurality of spacer members spacing the inner wall from the outer wall; and a plurality of fuel injector passages extending from an outer surface of the outer wall, through the plurality of spacer members and the inner wall to the inner HP air jet conduit, each fuel injector passage having a first end open at the outer surface of the outer wall and a second end including a fuel injector directed into the inner HP air jet conduit defined by the inner wall; and a fuel plenum defined in the HP air-fuel injection member and in fluid communication with the first end of each fuel injector passage, the fuel plenum configured to deliver a fuel from a fuel source to each of the fuel injectors, wherein each inner HP air jet conduit and each HP air jet loop are configured to direct a HP air flow from a HP air source with the fuel into the inlet of the mixing chamber.

16. The combustor of claim 15, wherein the HP air-fuel injection member further includes a plurality of HP air inlet openings downstream of the at least one row of HP air-fuel injectors for directing another HP air flow into the air-fuel mixture and into the inlet of the mixing chamber.

17. The combustor of claim 15, wherein the HP air flow also draws a low pressure (LP) air from a LP air source to direct the LP air with the HP air and the fuel into the inlet of the mixing chamber.

18. The combustor of claim 15, wherein the inner HP air jet conduit is elongated and includes a first end and a second end separated by a middle portion, and wherein each of the first end and the second end is narrower than the middle portion.

19. The combustor of claim 15, wherein the HP air jet loop has opposing sides each with a first longitudinal end portion and a second longitudinal end portion separated by a middle longitudinal portion, and wherein each of the first longitudinal end portion and the second longitudinal end portion is narrower than the middle longitudinal portion on each of the opposing sides.

20. A gas turbine (GT) system, comprising:

a compressor section;

a combustion section operatively coupled to the compressor section; and a turbine section operatively coupled to the combustion section, wherein the combustion section includes at least one combustor including:

a combustor body including a combustion liner;

a head end fuel nozzle assembly at a forward end of the combustor body; and a plurality of axial fuel stage (AFS) injectors directed into the combustor body downstream of the head end fuel nozzle assembly, at least one AFS injector including:

a mixing member including a mixing chamber defined therein, the mixing chamber having an inlet and an outlet, wherein the outlet is configured to be in fluid communication with a combustion chamber of the combustor;

a high pressure (HP) air-fuel injection member including at least one row of HP air-fuel injectors for directing an air-fuel mixture into the mixing chamber, each HP air-fuel injector including:

an inner wall defining an inner HP air jet conduit therein;

an outer wall surrounding and concentric with the inner wall, wherein the inner wall and the outer wall define an outer HP air jet loop therebetween;

a plurality of spacer members spacing the inner wall from the outer wall; and a plurality of fuel injector passages extending from an outer surface of the outer wall, through the plurality of spacer members and the inner wall to the inner HP air jet conduit, each fuel injector passage having a first end open at the outer surface of the outer wall and a second end including a fuel injector directed into the inner HP air jet conduit defined by the inner wall; and a fuel plenum defined in the HP air-fuel injection member and in fluid communication with the first end of each fuel injector passage, the fuel plenum configured to deliver a fuel from a fuel source to each of the fuel injectors, wherein each inner HP air jet conduit and each HP air jet loop are configured to direct a HP air flow from a HP air source with the fuel into the inlet of the mixing chamber.

* * * * *